US009566789B2

(12) United States Patent
Naito et al.

(10) Patent No.: US 9,566,789 B2
(45) Date of Patent: Feb. 14, 2017

(54) LIQUID DISCHARGE APPARATUS AND METHOD FOR PRODUCING PIEZOELECTRIC ACTUATOR

(71) Applicant: Brother Kogyo Kabushiki Kaisha, Nagoya-shi, Aichi-ken (JP)

(72) Inventors: Kyohei Naito, Nagoya (JP); Jiro Yamamoto, Nagoya (JP); Shohei Koide, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/053,035

(22) Filed: Feb. 25, 2016

(65) Prior Publication Data

US 2016/0243829 A1 Aug. 25, 2016

(30) Foreign Application Priority Data

Feb. 25, 2015 (JP) ..... 2015-034799

(51) Int. Cl.
*B41J 2/14* (2006.01)
*B41J 2/16* (2006.01)

(52) U.S. Cl.
CPC ..... *B41J 2/14233* (2013.01); *B41J 2/161* (2013.01); *B41J 2/1626* (2013.01); *B41J 2/1646* (2013.01); *B41J 2002/14491* (2013.01)

(58) Field of Classification Search
CPC . B41J 2/14233; B41J 2/14072; B41J 2/04521; B41J 2002/14491
See application file for complete search history.

(56) References Cited

U.S. PATENT DOCUMENTS

| | | | |
|---|---|---|---|
| 6,796,640 | B2 | 9/2004 | Miyata |
| 9,144,980 | B2 | 9/2015 | Watanabe et al. |
| 9,254,652 | B2 | 2/2016 | Yazaki |
| 2003/0117464 | A1 | 6/2003 | Miyata |

(Continued)

FOREIGN PATENT DOCUMENTS

| | | | |
|---|---|---|---|
| EP | 2889141 | A1 | 7/2015 |
| JP | 2003-246065 | A | 9/2003 |

(Continued)

OTHER PUBLICATIONS

Feb. 25, 2015—Co-pending U.S. Appl. No. 15/053,105.

*Primary Examiner* — Geoffrey Mruk
(74) *Attorney, Agent, or Firm* — Banner & Witcoff, Ltd.

(57) ABSTRACT

A liquid discharge apparatus is provided, which comprises a channel substrate formed with a plurality of first and second pressure chambers disposed in a first direction, a plurality of first and second individual electrodes, a piezoelectric film, a common electrode, and first traces. The first traces are connected to exposed portions of the first individual electrodes exposed from the piezoelectric film, and each of the first traces passes from the exposed portion between the two second individual electrodes to extend to the one side in the second direction. A cutout, which is cut out from the one side in the second direction, is formed so that the cutout is not overlapped with the first trace between portions of the common electrode opposed to the two adjoining second individual electrodes. The first trace is formed continuously from the exposed portion to an upper surface of the piezoelectric film.

18 Claims, 26 Drawing Sheets

(56) References Cited

U.S. PATENT DOCUMENTS

| | | | | |
|---|---|---|---|---|
| 2005/0270339 | A1 | 12/2005 | Sugahara | |
| 2014/0253641 | A1* | 9/2014 | Furuya | B41J 2/14201 347/71 |
| 2014/0292949 | A1 | 10/2014 | Yazaki | |
| 2015/0202875 | A1 | 7/2015 | Watanabe et al. | |
| 2015/0352848 | A1 | 12/2015 | Watanabe et al. | |
| 2016/0243830 | A1 | 8/2016 | Naito et al. | |

FOREIGN PATENT DOCUMENTS

| | | | |
|---|---|---|---|
| JP | 2005-349568 | A | 12/2005 |
| JP | 2014-054835 | A | 3/2014 |
| JP | 2014-188717 | A | 10/2014 |
| JP | 2016-155306 | A | 9/2016 |

* cited by examiner

LIQUID DISCHARGE APPARATUS AND METHOD FOR PRODUCING PIEZOELECTRIC ACTUATOR

CROSS REFERENCE TO RELATED APPLICATION

The present application claims priority from Japanese Patent Application No. 2015-034799 filed on Feb. 25, 2015 the disclosure of which is incorporated herein by reference in its entirety.

BACKGROUND

Field of the Invention

The present disclosure relates to a liquid discharge apparatus and a method for producing a piezoelectric actuator for the liquid discharge apparatus.

Description of the Related Art

Conventionally, an ink-jet head for an ink-jet printer is known, which serves as a liquid discharge apparatus for discharging ink onto a recording medium while moving in the scanning direction. The known ink-jet head includes, in some cases, a nozzle plate which is formed with a plurality of nozzles, a channel forming member which is formed with a plurality of pressure chambers, and a plurality of piezoelectric elements which are provided corresponding to the plurality of pressure chambers on the upper surface of the channel forming member.

The plurality of nozzles, which are formed for the nozzle plate, are arranged in two arrays. Further, the plurality of pressure chambers and the plurality of piezoelectric elements are also arranged in two arrays corresponding to the arrangement of the plurality of nozzles. Individual electrodes of the respective piezoelectric elements are arranged on the lower side of a piezoelectric film. Traces (lead electrodes) are connected to the individual electrodes. Each of the traces is led out from the corresponding individual electrode to an area disposed between the two piezoelectric element arrays along with the direction orthogonal to the nozzle arrangement direction. Each of trace members is joined to the area disposed between the two piezoelectric element arrays on the upper surface of the channel forming member. The trace members are electrically connected to the plurality of traces led out from the plurality of individual electrodes.

The ink-jet head is known such that the trace, which is connected to each of the individual electrodes, is led out to the area disposed between the two piezoelectric element arrays on the upper surface of the channel forming member, and the trace member is joined to the area. In the case of this structure, it is necessary that the two piezoelectric element arrays should be arranged while being separated from each other in order to secure the joining area with respect to the trace member on the upper surface of the channel forming member. In accordance therewith, the distance between the two nozzle arrays is also increased. According to the knowledge of the inventors, if the distance between the two nozzle arrays is increased, various problems arise. For example, when the reciprocating movement is performed in the scanning direction of the ink-jet head, the distance of movement is lengthened in one time movement (also referred to as "path"). Further, when the ink-jet head is attached while being inclined, the deviation is increased between the landing positions of the ink to be discharged from the two nozzle arrays respectively. Further, a problem also arises such that the size of the nozzle plate is increased, which results in the increase in the cost.

SUMMARY

An object of the present teaching is to decrease the distance between two nozzle arrays by contriving the leading out of traces from two arrays of individual electrodes.

According to a first aspect of the present teaching, there is provided a liquid discharge apparatus constructed to discharge a liquid, comprising:

a channel substrate formed with a plurality of first pressure chambers which are disposed in a first direction, and a plurality of second pressure chambers which are disposed in the first direction and which are arranged on one side in a second direction orthogonal to the first direction with respect to the plurality of first pressure chambers;

a plurality of first individual electrodes which are arranged to be opposed to the first pressure chambers;

a plurality of second individual electrodes which are arranged to be opposed to the second pressure chambers;

a piezoelectric film which is arranged to cover the plurality of first individual electrodes and the plurality of second individual electrodes in a stacking direction;

a common electrode which is arranged so that the common electrode covers the piezoelectric film in the stacking direction and the common electrode is opposed to the plurality of first individual electrodes and the plurality of second individual electrodes; and first traces which are connected to exposed portions of the first individual electrodes exposed from the piezoelectric film and each of which passes from the exposed portion between the two second individual electrodes adjoining in the first direction to extend to the one side in the second direction, wherein:

a cutout, which is cut out from the one side in the second direction so that the cutout is not overlapped with the first trace, is formed between portions of the common electrode opposed to the two adjoining second individual electrodes; and the first trace is formed continuously from the exposed portion to an upper surface of the piezoelectric film.

The channel substrate is formed with the plurality of first pressure chambers which are disposed in the first direction, and the plurality of second pressure chambers which are disposed in the first direction and which are arranged on one side in the second direction with respect to the first pressure chamber. Further, the first individual electrodes are opposed to the first pressure chambers, and the second individual electrodes are opposed to the second pressure chambers. The second individual electrodes are arranged on the one side in the second direction with respect to the first individual electrodes in accordance with the relationship of arrangement of the first pressure chambers and the second pressure chambers. The piezoelectric film is arranged so that the piezoelectric film covers the first individual electrodes and the second individual electrodes. Further, the first individual electrode has the exposed portion exposed from the piezoelectric film, and the first trace is connected to the exposed portion. The first trace passes from the exposed portion between the two second individual electrodes adjoining in the first direction, and the first trace extends to the one side in the second direction.

In other words, according to the present teaching, the first trace, which is connected to the first individual electrode, passes between the two second individual electrodes, and the first trace extends to the one side in the second direction. In the case of this structure, it is unnecessary to secure any arrangement area for the contacts to be connected to the first traces between the plurality of first individual electrodes and the plurality of second individual electrodes. Therefore, it is possible to decrease the distance in the second direction between the first pressure chambers and the second pressure chambers. Accordingly, it is also possible to decrease the distance in the second direction between the nozzles communicated with the first pressure chambers and the nozzles communicated with the second pressure chambers.

Further, the first individual electrode is the electrode covered with the piezoelectric film. Therefore, it is also possible to adopt such a structure that the first trace, which is connected to the first individual electrode and which passes between the two second individual electrodes, is arranged on the lower side of the piezoelectric film. In this case, the first trace is formed previously, and the piezoelectric film is formed as a film thereon. However, if the first trace is formed previously, it is feared that any problem may arise, for example, in relation to the uneven film formation of the piezoelectric film and the change of the orientation. In relation thereto, according to the present teaching, the first trace is formed continuously from the exposed portion of the first individual electrode to the upper surface of the piezoelectric film. In the case of this structure, the first trace is formed after the piezoelectric film is formed as the film. Therefore, the problem as described above does not arise, which would otherwise result from the film formation of the piezoelectric film on the first trace. Further, owing to the fact that the first trace is arranged continuously from the exposed portion to the upper surface of the piezoelectric film, the conduction reliability is raised with respect to the exposed portion of the first individual electrode, as compared with a structure in which the first trace does not override the piezoelectric film.

Further, according to the present teaching, the common electrode, which covers the piezoelectric film, has such a cutout shape that the common electrode is cut out from the one side in the second direction between the two second individual electrodes. Therefore, the first trace, which is formed on the piezoelectric film, can be arranged between the two second individual electrodes without being brought in contact with the common electrode.

According to a second aspect of the present teaching, there is provided a method for producing a piezoelectric actuator, comprising:

forming, on a channel substrate, a plurality of first individual electrodes which are disposed in a first direction, and a plurality of second individual electrodes which are disposed in the first direction and which are arranged on one side in a second direction orthogonal to the first direction with respect to the plurality of first individual electrodes;

forming, as a film, a piezoelectric film so that the plurality of first individual electrodes and the plurality of second individual electrodes are covered therewith;

removing the piezoelectric film which covers portions of the first individual electrodes to form exposed portions which are exposed from the piezoelectric film;

forming, on a surface of the piezoelectric film disposed on a side opposite to the channel substrate, a common electrode which is opposed to the plurality of first individual electrodes and the plurality of second individual electrodes and which has cutouts cut out from the one side in the second direction, the cutout being disposed between portions opposed to the two second individual electrodes adjoining in the first direction; and forming traces connected to the exposed portions after forming the common electrode, the trace being allowed to pass through an area of the common electrode disposed between the two second individual electrodes in which the cutout is formed and the trace extending to the one side in the second direction.

According to the present teaching, the piezoelectric film, which covers the plurality of first individual electrodes and the plurality of second individual electrodes, is formed as the film, and then the common electrode, which has the cutout shape between the two adjoining second individual electrodes, is formed. After that, the trace, which is connected to the first individual electrode, is formed so that the trace passes through the area between the two second individual electrodes in which the cutout shape of the common electrode is formed.

The trace of the first individual electrode passes between the two adjoining second individual electrodes, and the trace extends to the one side in the second direction. Therefore, it is unnecessary to secure any area of arrangement of the contact connected to the first trace between the first individual electrode and the second individual electrode. Therefore, it is possible to decrease the distance in the second direction between the nozzle communicated with the first pressure chamber and the nozzle communicated with the second pressure chamber. Further, according to the present invention, the trace is formed after forming the piezoelectric film as the film. Therefore, any harmful influence is not exerted on the piezoelectric film by the trace, unlike such a case that the trace is formed previously and the piezoelectric film is formed as a film thereon. Further, the common electrode has the cutout shape between the two second individual electrodes. Therefore, the trace, which is connected to the first individual electrode, can be arranged between the two second individual electrodes without being brought in contact with the common electrode.

BRIEF DESCRIPTION OF THE DRAWINGS

In FIG. 5B, the nozzles 30 and the pressure chambers 51 are omitted.

FIGS. 7A and 7B depict enlarged views illustrating connecting portions between a first exposed portion and a first trace, wherein FIG. 7A depicts a case in which the first trace is formed up to an upper surface of a piezoelectric film, and FIG. 7B depicts a case in which the first trace is not formed up to the upper surface of the piezoelectric film.

In FIG. 9B, the nozzles 30 and the pressure chambers 51 are omitted.

In FIG. 10B, the nozzles 30 and the pressure chambers 51 are omitted.

In FIG. 11B, the nozzles 30 and the pressure chambers 51 are omitted.

In FIG. 12B, the nozzles 30 and the pressure chambers 51 are omitted.

In FIG. 13B, the nozzles 30 and the pressure chambers 51 are omitted.

In FIG. 14B, the nozzles 30 and the pressure chambers 51 are omitted.

In FIG. 15B, the nozzles 30 and the pressure chambers 51 are omitted.

In FIG. 16B, the nozzles 30 and the pressure chambers 51 are omitted.

DESCRIPTION OF THE EMBODIMENTS

Figure 1:
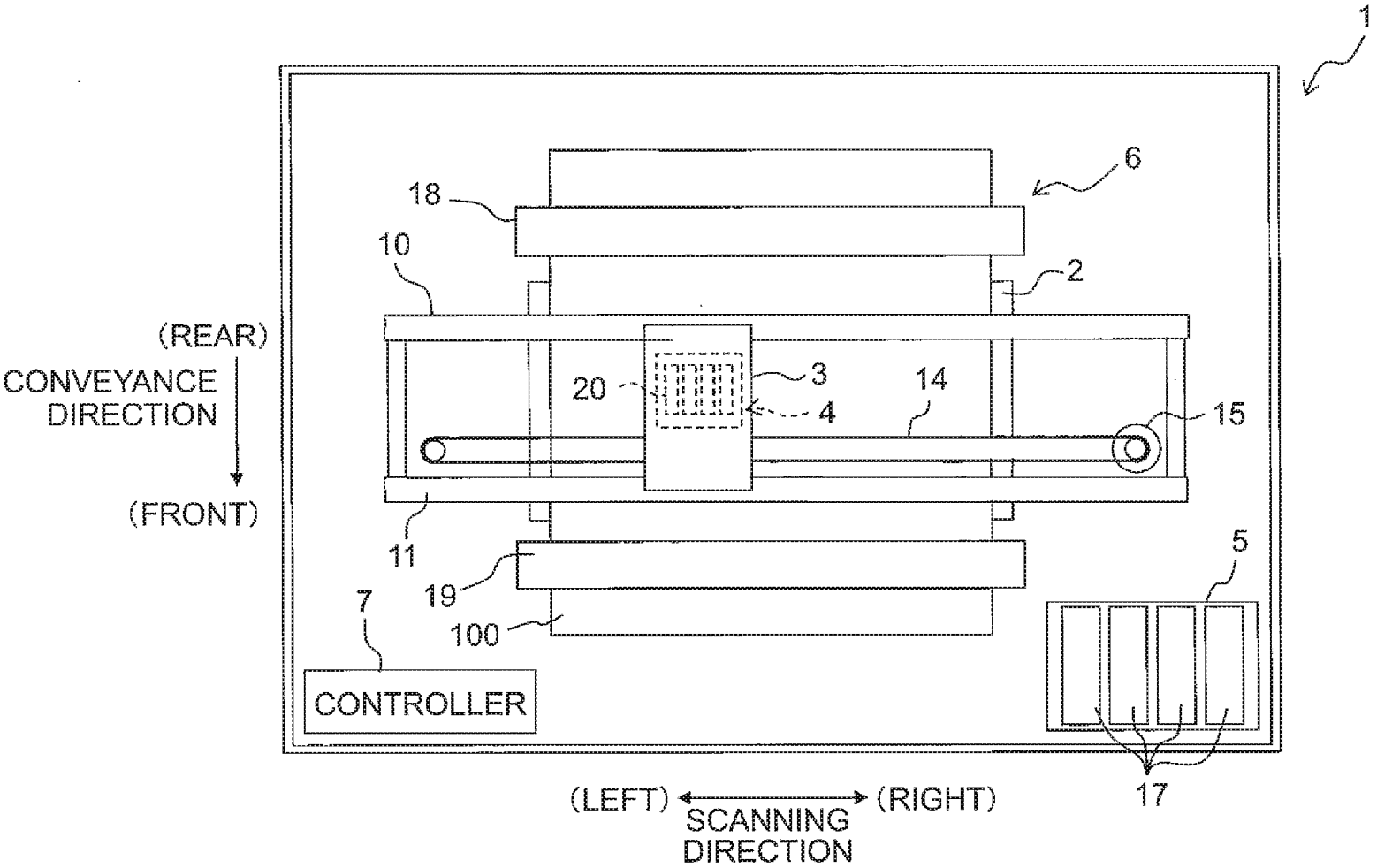
FIG. 1 depicts a schematic top view illustrating a printer according to an embodiment of the present invention.

Next, an embodiment of the present teaching will be explained. An explanation will be made with reference to FIG. 1 about a schematic arrangement of the ink-jet printer 1. Note that the respective front, rear, left, and right directions depicted in FIG. 1 are defined as "front", "rear", "left", and "right" of the printer. Further, the front side of the paper surface is defined as "upward", and the rear side of the paper surface is defined as "downward".

<Schematic Arrangement of Printer>

As depicted in FIG. 1, the ink-jet printer 1 comprises, for example, a platen 2, a carriage 3, an ink-jet head 4, a cartridge holder 5, a conveyance mechanism 6, and a controller 7.

Recording paper 100 as a recording medium is placed on the upper surface of the platen 2. The carriage 3 is reciprocatively movable in the left-right direction (hereinafter referred to as "scanning direction" as well) along two guide rails 10, 11 in an area opposed to the platen 2. An endless belt 14 is connected to the carriage 3. The endless belt 14 is driven by a carriage driving motor 15, and thus the carriage 3 is moved in the scanning direction.

The ink-jet head 4 is attached to the carriage 3, and the ink-jet head 4 is movable in the scanning direction together with the carriage 3. The ink-jet head 4 is provided with four head units 20 which are aligned in the scanning direction. The ink-jet head 4 is connected by unillustrated tubes respectively to the cartridge holder 5 to which ink cartridges 17 of four colors (black, yellow, cyan, and magenta) are installed. A plurality of nozzles 30 are formed on the lower surface of each of the head units 20 (surface disposed on the back side of the paper surface as viewed in FIG. 1) (see FIGS. 2 to 5). The nozzles 30 of each of the head units 20 discharge the inks supplied from the ink cartridges 17 toward the recording paper 100 placed on the platen 2.

The conveyance mechanism 6 has two conveyance rollers 18, 19 which are arranged so that the platen 2 is interposed therebetween in the front-back direction. The conveyance mechanism 6 conveys the recording paper 100 placed on the platen 2 in the frontward direction (hereinafter referred to as "conveyance direction" as well) by means of the two conveyance rollers 18, 19.

The controller 7 includes, for example, ROM (Read Only Memory), RAM (Random Access Memory), and ASIC (Application Specific Integrated Circuit) including various control circuits. The controller 7 executes various processes including, for example, the printing on the recording paper 100 and the maintenance of the ink-jet head 4 by using ASIC in accordance with programs stored in ROM.

For example, in the printing process, the controller 7 controls, for example, the ink-jet head 4 and the carriage driving motor 15 on the basis of the printing instruction input from an external device such as PC or the like so that an image or the like is printed on the recording paper 100. Specifically, the ink discharge operation in which the ink is discharged while moving the ink-jet head 4 in the scanning direction together with the carriage 3 and the conveyance operation in which the recording paper 100 is conveyed by a predetermined amount in the conveyance direction by means of the conveyance rollers 18, 19 are alternately performed.

<Ink-Jet Head>

Next, an explanation will be made about the structure of the ink-jet head 4.

Figure 2:
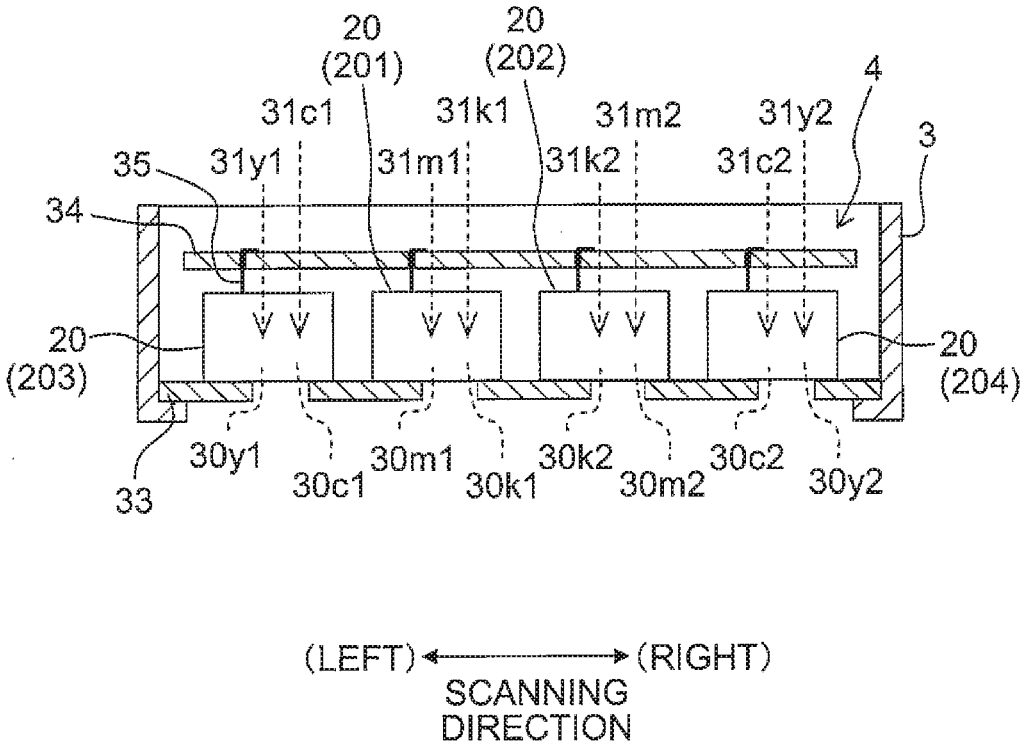
FIG. 2 depicts a sectional view illustrating a carriage to which four head units are attached.

As depicted in FIG. 2, a plate-shaped unit holder 33 is provided at the lower portion of the carriage 3. The four head units 20 are attached to the upper surface of the unit holder 33 while being aligned in the scanning direction. Further, the carriage 3 is provided with a circuit board 34 which is arranged to extend over the four head units 20 over or above the four head units 20. The circuit board 34 is electrically connected to the controller 7 of the printer 1 (see FIG. 1). The instruction from the controller 7 is received, and various control signals are output to the respective head units 20. The four head units 20 are connected to the circuit board 34 respectively by COF 35 (Chip On Film) as a trace member. As the trace member, it is possible to use a flexible print circuit (FPC).

Figure 3:
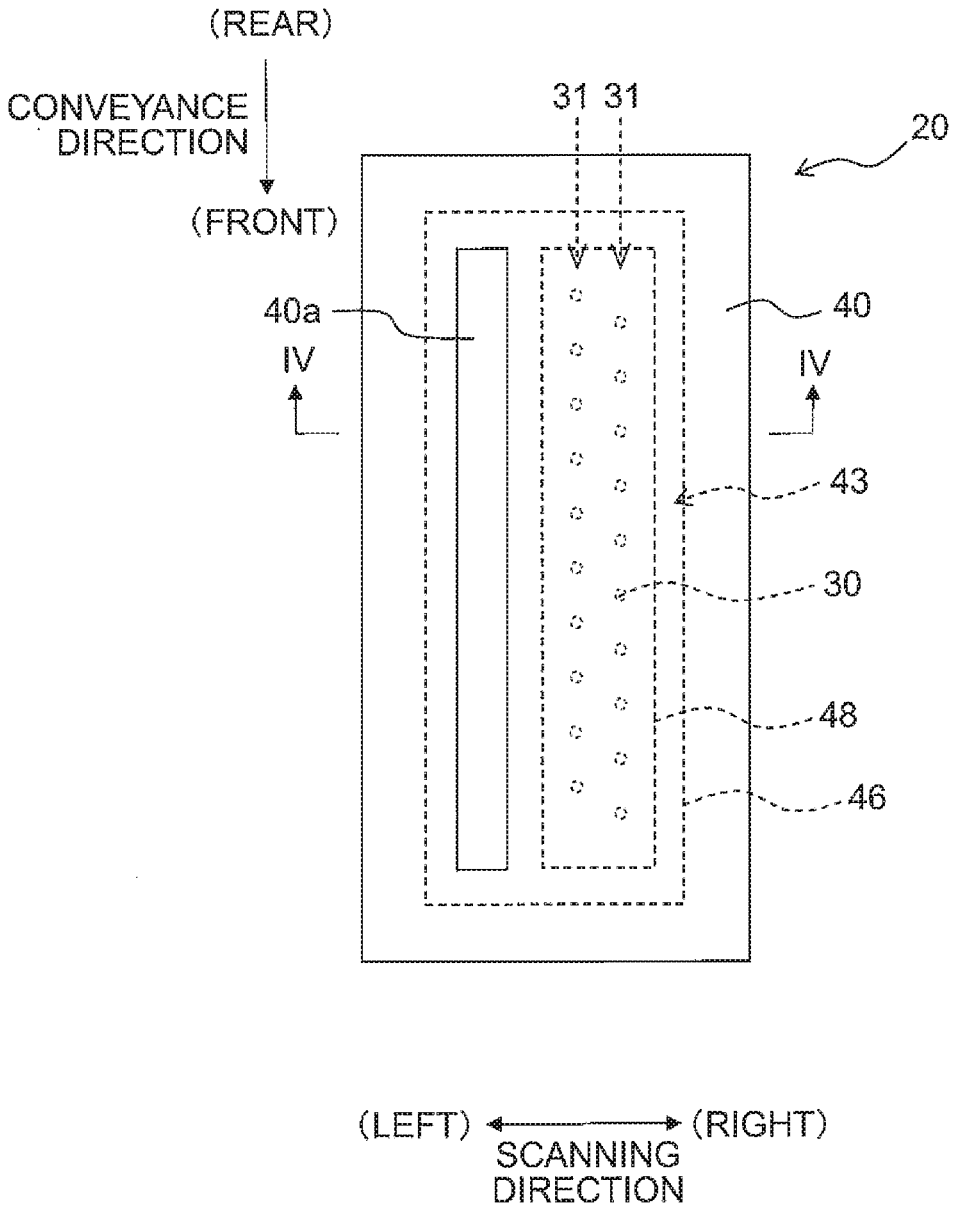
FIG. 3 depicts a top view illustrating one head unit of an ink-jet head.

The plurality of nozzles 30 are formed on the lower surface of each of the head units 20. The plurality of nozzles 30 of each of the head units 20 are exposed from openings formed for the unit holder 33. As depicted in FIG. 3, the plurality of nozzles 30 are arranged in the conveyance direction to construct two nozzle arrays 31. Note that the positions of the nozzles 30 are deviated in the conveyance direction between the two nozzle arrays 31, and the plurality of nozzles 30 are arranged in a so-called zigzag form.

The two nozzle arrays 31 of one head unit 20 discharge the ink of different colors respectively. Note that in the following explanation, as for those of the constitutive elements of the printer 1 corresponding to the inks of black (K), yellow (Y), cyan (C), and magenta (M) respectively, any one of signs of "k" to indicate black, "y" to indicated yellow, "c"

to indicate cyan, and "m" to indicate magenta is appropriately affixed after the symbol to indicate the constitutive element so as to understand to which ink the symbol corresponds. For example, the nozzle 31*k* indicates the nozzle array 31 for discharging the black ink.

The four types of nozzle arrays 31, which discharge the inks of four colors respectively, are arranged in bilateral symmetry (left-right symmetry) in relation to the four head units 20 as a whole. Specifically, the head unit 201 and the head unit 202, which are included in the four head units 20 and which are arranged on the inner side in the scanning direction respectively, have the nozzle arrays 31*k* for the black positioned on the inner side and the nozzle arrays 31*m* for the magenta arranged on the outer side. Further, the head unit 203 arranged on the left side of the head unit 201 and the head unit 204 arranged on the right side of the head unit 202, i.e., the two head units 203, 204 disposed on the outer sides respectively have the nozzle arrays 31*c* for the cyan positioned on the inner side and the nozzle arrays 31*y* for the yellow positioned on the outer side.

In other words, the two nozzle arrays 31 exist for one color ink in the ink-jet head 4 having the four head units 20. Therefore, the eight nozzle arrays 31 exist in the entire ink-jet head 4. Then, the eight nozzle arrays 31 are arranged in an order of the nozzle arrays 31*k* for the black, the nozzle arrays 31*m* for the magenta, the nozzle arrays 31*c* for the cyan, and the nozzle arrays 31*y* for the yellow as referred to from the inner side toward the both left and right sides. Note that in FIG. 2, as for the nozzles 30 and the nozzle arrays 31 for the respective colors, those arranged on the left side are affixed with the symbol "1", and those arranged on the right side are affixed with the symbol "2". For example, the nozzle 30*c*1 is the nozzle 30 which is arranged on the left side and which discharges the cyan ink.

That is, the nozzle arrays 31 for the four colors are arranged in left-right symmetry in an order of black, magenta, cyan, and yellow as referred to from the central side. In the case of the structure as described above, it is possible to obtain the same landing sequence of the four color inks onto the recording paper 100 between when the carriage 3 is moved leftwardly and when the carriage 3 is moved rightwardly. Accordingly, it is possible to suppress the difference in the color to be small in the bidirectional printing between the image portion which is formed when the carriage 3 is moved leftwardly and the image portion which is formed when the carriage 3 is moved rightwardly.

<Head Unit>

Figure 4:
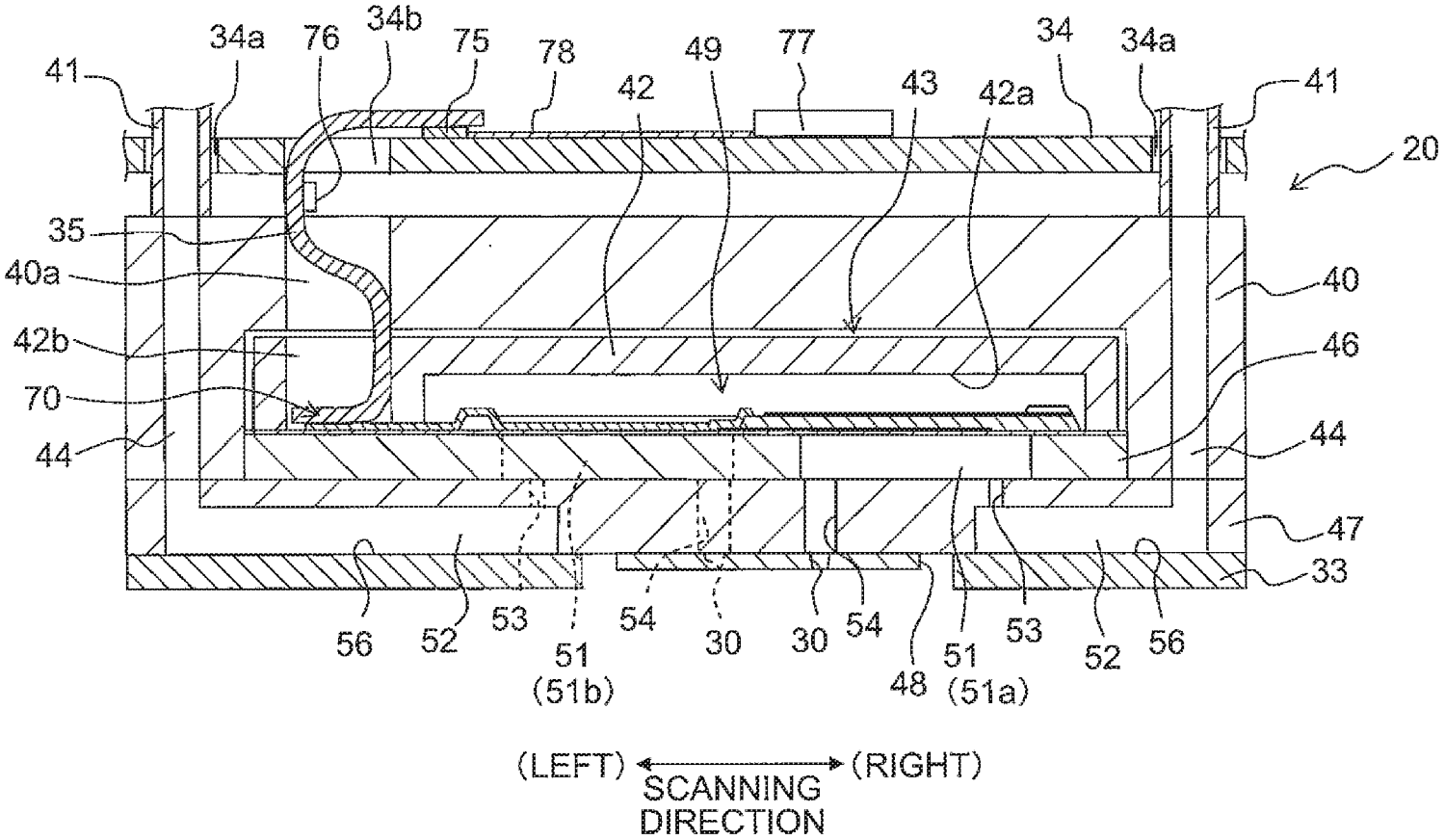
FIG. 4 depicts a sectional view taken along a line IV-IV depicted in FIG. 3.

Next, an explanation will be made about the structure of the head unit 20. Note that all of the four head units 20 of the ink-jet head 4 are constructed identically. Therefore, one of the four head units 20 will be explained, and the other head units 20 are omitted from the explanation. Note that in FIG. 5A, a protective member 42 depicted in FIGS. 4 and 6 is schematically depicted by alternate long and two short dashes lines. Further, note that in FIG. 5B, the nozzles 30 and the pressure chambers 51 are omitted. In the same way, in FIGS. 9B, 10B, 11B, 12B, 13B, 14B and 15B which are later described, the nozzles 30 and the pressure chambers 51 are also omitted.

As depicted in FIGS. 3 and 4, the head unit 20 has a holder member 40 and a main head body 43 which is retained by the holder member 40. The holder member 40 is formed of, for example, synthetic resin or metal. Two left and right ink supply channels 44 are formed respectively at two portions of the holder member 40 to interpose the main head body 43 in the scanning direction (left-right direction).

Through-holes 34*a* are formed through the circuit board 34 arranged over or above the head unit 20. Cylindrical channel members 41, which are provided to supply the ink to the head unit 20, penetrate through the circuit board 34 at the through-holes 34*a*. The ink supply channels 44 of the holder member 40 are connected to the cartridge holder 5 (see FIG. 1) via the channel members 41 described above. Then, the ink of the ink cartridges 17 of two colors (black and magenta or cyan and yellow) installed to the cartridge holder 5 is supplied respectively to the main head body 43 via the ink supply channels 44. Further, a through-hole 34*b*, which is provided to allow COF 35 connected to the piezoelectric actuator 49 of the main head body 43 to pass therethrough, is formed at the left end portion of the holder member 40.

The main head body 43 has an upper substrate 46, an intermediate substrate 47, a lower substrate 48, and a piezoelectric actuator 49. Channel holes, which are provided as parts of the ink channels, are formed through the upper substrate 46, the intermediate substrate 47, and the lower substrate 48 respectively. Note that each of the upper substrate 46, the intermediate substrate 47, and the lower substrate 48 is composed of a silicon single crystal substrate.

As depicted in FIGS. 4 to 6, the plurality of pressure chambers 51 are formed for the upper substrate 46. The plurality of pressure chambers 51 include a plurality of first pressure chambers 51*a* which are arranged on the right side and a plurality of second pressure chambers 51*b* which are arranged on the left side. The plurality of first pressure chambers 51*a* are arranged in the conveyance direction corresponding to the plurality of nozzles 30 for constructing the right side nozzle array 31 respectively. The plurality of second pressure chambers 51*b* are arranged in the conveyance direction corresponding to the plurality of nozzles 30 for constructing the left side nozzle array 31 respectively on the left side as compared with the plurality of first pressure chambers 51*a*. Each of the pressure chambers 51 has a rectangular shape as viewed above which is long in the scanning direction.

The upper substrate 46 has a vibration film 57 which covers the plurality of pressure chambers 51 (first pressure chambers 51*a*, second pressure chambers 51*b*). The vibration film 57 is a film composed of silicon dioxide ($SiO_2$) or silicon nitride (SiNx) formed by oxidizing or nitriding a part of the upper substrate 46 of silicon. An electric connecting portion 70, which is arranged with contacts 71*a*, 71*b*, 72 of the piezoelectric actuator 49 described later on, is provided on the upper surface of the left end portion of the upper substrate 46. COF 35 is joined to the electric connecting portion 70.

The intermediate substrate 47 is joined to the lower surface of the upper substrate 46. Two left and right manifolds 52, which are communicated with the two ink supply channels 44 of the holder member 40 respectively, are formed for the intermediate substrate 47. The right manifold 52 is overlapped with the right end portions of the plurality of first pressure chambers 51*a*, and the right manifold 52 extends in the conveyance direction (direction perpendicular to the paper surface of FIG. 4). The left manifold 52 is overlapped with the left end portions of the plurality of second pressure chambers 51*b*, and the left manifold 52 extends in the conveyance direction. Note that the manifold 52 of the intermediate substrate 47 is formed while protruding outwardly in the scanning direction as compared with the pressure chamber 51. On this account, the width of the intermediate substrate 47 in the scanning direction is larger than the width of the upper substrate 46 in the scanning direction.

The lower side of each of the manifolds 52 is covered with a film 56 made of synthetic resin. The unit holder 33, which retains the head unit 20, is arranged on the lower side of the film 56. A plurality of communication holes 53, which make communication between the manifolds 52 and the plurality of pressure chambers 51 respectively, are formed through the intermediate substrate 47. Further, a plurality of communication holes 54, which make communication between the plurality of pressure chambers 51 and the plurality of nozzles 30 formed for the lower substrate 48 as described below, are also formed through the intermediate substrate 47.

The lower substrate 48 is joined to the lower surface of the intermediate substrate 47. The lower substrate 48 is formed with the plurality of nozzles 30 which are arranged in the conveyance direction. As described above, the plurality of nozzles 30 constitute the two nozzle arrays 31. The respective nozzles 30 are communicated with the pressure chambers 51 of the upper substrate 46 (first pressure chambers 51*a*, second pressure chambers 51*b*) via the communication holes 54 formed through the intermediate substrate 47. Note that the lower substrate 48 is not joined to the entire region of the lower surface of the intermediate substrate 47, but the lower substrate 48 is joined to only an area of the intermediate substrate 47 in which the plurality of communication holes 54 are formed. Therefore, the width of the lower substrate 48 in the scanning direction is smaller than the width of the upper substrate 46 and the width of the intermediate substrate 47.

The piezoelectric actuator 49 applies the discharge energy to the ink contained in the plurality of pressure chambers 51 in order that the ink is discharged from the nozzles 30 respectively. As depicted in FIGS. 4 to 6, the piezoelectric actuator 49 is arranged on the upper surface of the vibration film 57 of the upper substrate 46. The piezoelectric actuator 49 has, for example, a plurality of individual electrodes 60, a piezoelectric film 61, and a common electrode 62.

The plurality of individual electrodes 60 are arranged on the upper surface of the vibration film 57 of the upper substrate 46 while being opposed to the plurality of pressure chambers 51 respectively. That is, the plurality of first individual electrodes 60*a* are arranged in the conveyance direction while corresponding to the plurality of first pressure chambers 51*a* respectively. The plurality of second individual electrodes 60*b* are arranged in the conveyance direction while corresponding to the plurality of second pressure chambers 51*b* respectively. Each of the individual electrodes 60 is formed of platinum (Pt). Each of the individual electrodes 60 has a rectangular shape which is smaller than the pressure chamber 51 as viewed in a plan view.

Figure 5A:
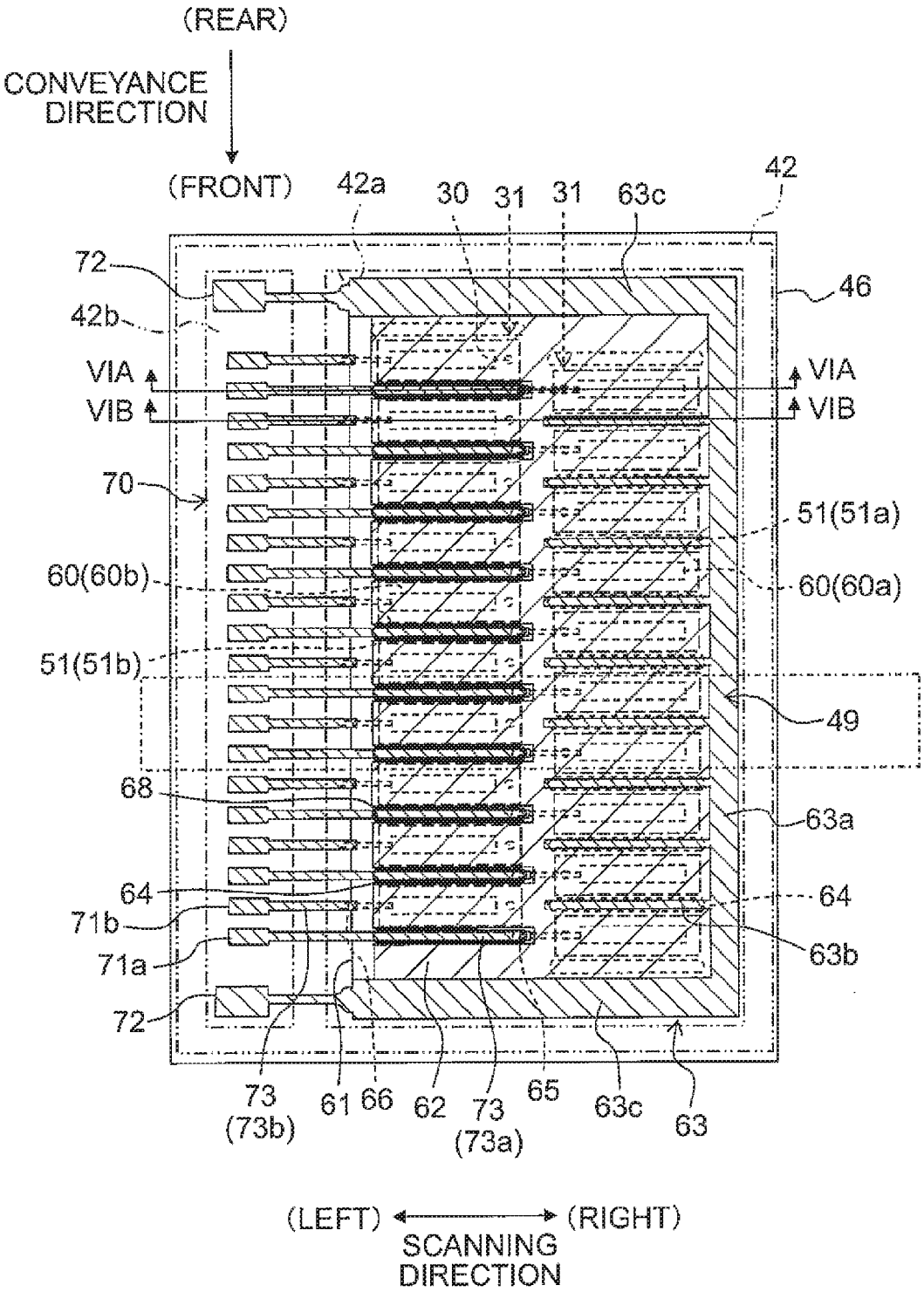
FIG. 5A depicts a top view illustrating an upper substrate of the head unit.
Figure 5B:
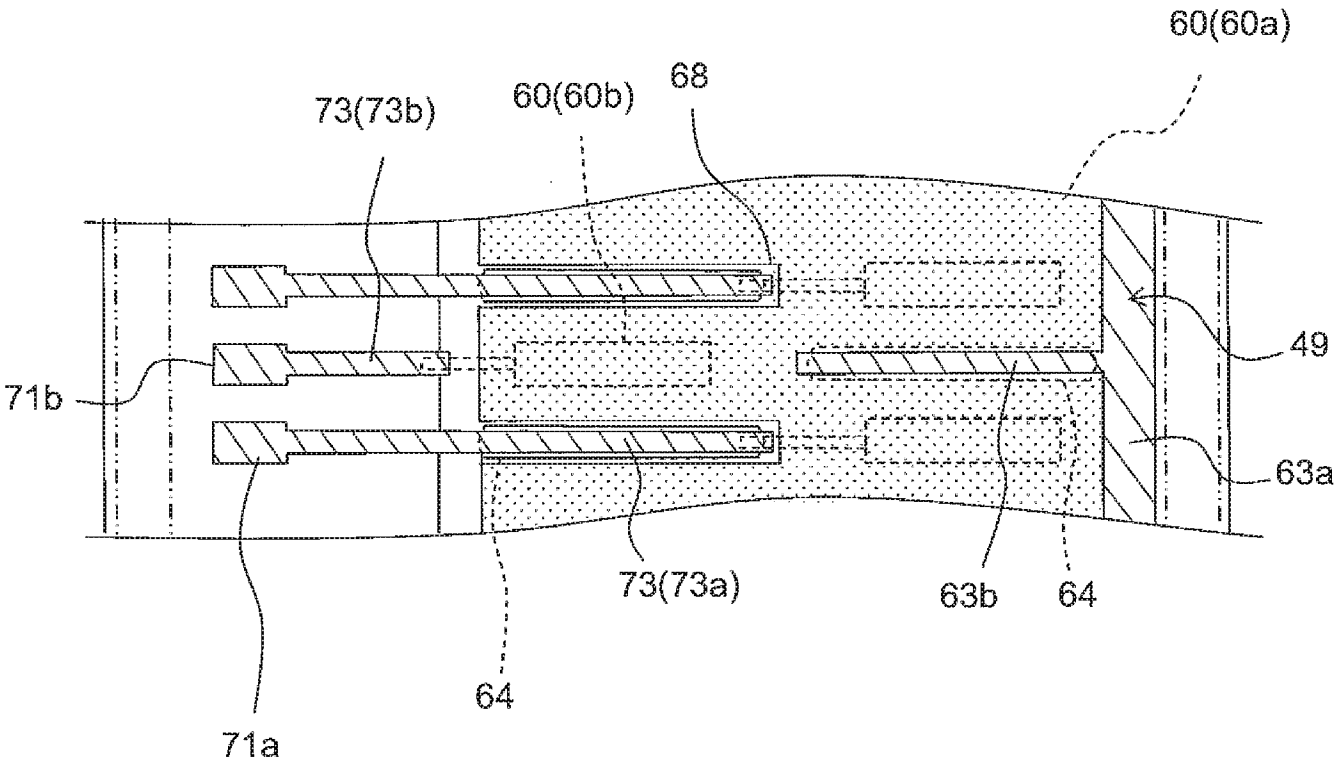
FIG. 5B depicts an enlarged view of a region enclosed by the one-dot chain line depicted in FIG. 5A.
Figure 6A:
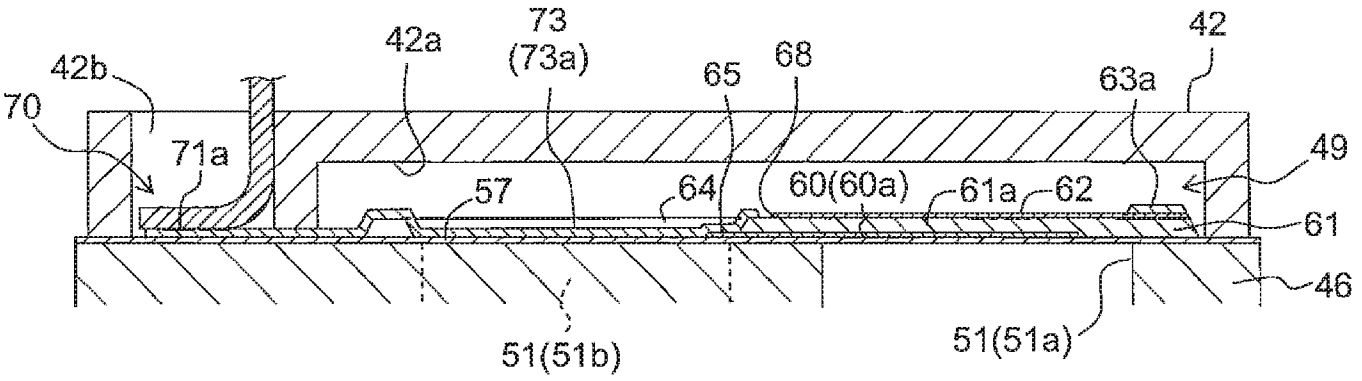
FIG. 6A depicts a sectional view taken along a line VIA-VIA depicted in FIG. 5A.
Figure 6B:
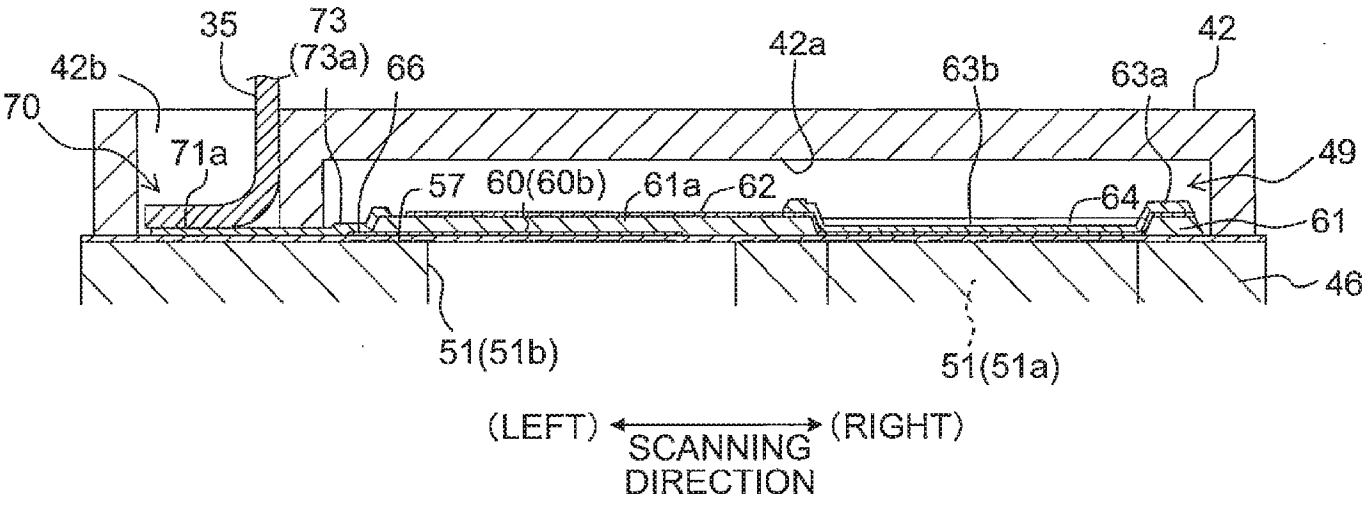
FIG. 6B depicts a sectional view taken along a line VIE-VIE depicted in FIG. 5A.

As depicted in FIGS. 5A to 6, the piezoelectric film 61, which is composed of a piezoelectric material such as PZT (lead titanate zirconate) or the like, is formed on the upper surface of the vibration film 57. The piezoelectric film 61 commonly covers both of the plurality of first individual electrodes 60*a* disposed on the right side and the plurality of second individual electrodes 60*b* disposed on the left side. As depicted in FIGS. 5A, 5B and 6B, a slit 64, which extends in the scanning direction, is formed at a portion of the right side portion of the piezoelectric film 61 disposed between the two first individual electrodes 60*a* which adjoin in the conveyance direction. Further, as depicted in FIGS. 5A, 5B and 6A, a slit 64, which extends in the scanning direction, is also formed at a portion of the left side portion of the piezoelectric film 61 disposed between the two second individual electrodes 60*b* which adjoin in the conveyance direction. In other words, the two slits 64 of the piezoelectric film 61 are arranged respectively on the both sides in the conveyance direction of each of the individual electrodes 60. Note that the length in the scanning direction and the width in the conveyance direction are identical between the slit 64 on the right side arranged between the first individual electrodes 60*a* and the slit 64 on the left side arranged between the second individual electrodes 60*b*. Owing to the fact that the slit 64 is formed for the piezoelectric film 61 between the two individual electrodes 60 which adjoin in the conveyance direction, it is easy to greatly deform the portion of the piezoelectric film 61 opposed to each of the pressure chambers 51.

The left end portion of the first individual electrode 60*a* further extends leftwardly beyond the left end of the first pressure chamber 51*a*, and the left end portion of the first individual electrode 60*a* is arranged at the position overlapped with the right end portion of the slit 64 of the piezoelectric film 61. In the slit 64, the left end portion of the first individual electrode 60*a* is exposed from the piezoelectric film 61 to constitute a first exposed portion 65. The left end portion of the second individual electrode 60*b* further extends leftwardly beyond the left end of the second pressure chamber 51*b*, and the left end portion of the second individual electrode 60*b* is exposed from the edge on the left side of the piezoelectric film 61 to constitute a second exposed portion 66.

The common electrode 62 is arranged so that the piezoelectric film 61 is covered therewith. The common electrode 62 is formed of, for example, iridium (Ir). Further, the common electrode 62 is opposed to the plurality of individual electrodes 60 (first individual electrodes 60*a*, second individual electrodes 60*b*) with the piezoelectric film 61 intervening therebetween. Each of cutouts 68, which is cut out from the left side, is formed between portions of the left side portion of the common electrode 62 opposed to the two second individual electrodes 60*b* which adjoin in the conveyance direction. Accordingly, the left side portion of the common electrode 62 is formed to have a comb-shaped form extending leftwardly from the central portion of the common electrode 62. In other words, the common electrode 62 is not arranged between the two second individual electrodes 60*b* which adjoin in the conveyance direction.

Note that the portion of the piezoelectric film 61 (hereinafter referred to as "active portion 61*a*" as well), which is interposed between the individual electrode 60 and the common electrode 62, is polarized upwardly in the thickness direction, i.e., in the direction directed from the individual electrode 60 disposed on the lower side to the common electrode 62 disposed on the upper side.

An auxiliary conductor 63, which is arranged while being brought in contact with the common electrode 62, is provided on the common electrode 62. The auxiliary conductor 63 makes contact with different portions of the common electrode 62 to construct distinct current routes among the different portions. Accordingly, the auxiliary conductor 63 suppresses any dispersion of the electric potential in the common electrode 62. The auxiliary conductor 63 is formed of a metal material having a small electric resistivity including, for example, gold (Au) and aluminum (Al). Further, the thickness of the auxiliary conductor 63 is larger than the thickness of the common electrode 62. The auxiliary conductor 63 has a first conductive portion 63*a*, a plurality of second conductive portions 63*b* which are in conduction with the first conductive portion 63*a*, and two third conductive portions 63*c* which are in conduction with the first conductive portion 63*a*.

The first conductive portion 63*a* is arranged on the portion of the common electrode 62 disposed on the right side as compared with the plurality of first individual electrodes 60*a*. The first conductive portion 63*a* extends in the conveyance direction over the plurality of first individual electrodes 60*a*. Each of the second conductive portions 63*b* is arranged on the common electrode 62, and each of the second conductive portions 63*b* extends in the scanning direction between the two first individual electrodes 60*a* that adjoin in the conveyance direction. The two third conductive portions 63*c* are connected to the front end portion and the back end portion of the first conductive portion 63*a* respectively. The two third conductive portions 63*c* are arranged at the front side portion and the back side portion of the common electrode 62 as compared with the plurality of individual electrodes 60, and the two third conductive portions 63*c* extend leftwardly from the first conductive portion 63*a* respectively.

The electric connecting portion 70 is provided on the upper surface of the left end portion of the upper substrate 46. The electric connecting portion 70 has a plurality of first driving contacts 71*a*, a plurality of second driving contacts 71*b*, and two ground contacts 72.

A plurality of traces 73 are connected to the plurality of individual electrodes 60 respectively. The respective traces 73 are led out leftwardly from the individual electrodes 60, and the respective traces 73 extend to the driving contacts 71 of the electric connecting portion 70 provided at the left end portion of the upper substrate 46. The respective traces 73 are formed after the film formation of the piezoelectric film 61. As depicted in FIGS. 6A and 6B, a part of the trace 73 is arranged on the piezoelectric film 61. Further, the plurality of traces 73 are formed of the same material as that of the auxiliary conductor 63 (for example, gold or aluminum), and the plurality of traces 73 are formed in accordance with the same film formation process. Therefore, the material and the thickness of the traces 73 are the same as those of the auxiliary conductor 63. Further, the thickness of the trace 73 is larger than the thickness of the individual electrode 60.

As depicted in FIGS. 5 and 6A, the first exposed portion 65 of the first individual electrode 60*a* on the right side is exposed from the piezoelectric film 61 in the slit 64 between the two second individual electrodes 60*b*. The right end portion of the first trace 73*a* corresponding to the first individual electrode 60*a* is formed continuously from the first exposed portion 65 to the upper surface of the piezoelectric film 61. Further, the first trace 73*a* passes between the two second individual electrodes 60*b* in the slit 64 from the first exposed portion 65, and the first trace 73*a* extends leftwardly along with the upper surface of the vibration film 57 of the upper substrate 46. Further, the first trace 73*a* climbs over the left end portion of the piezoelectric film 61, and the first trace 73*a* is connected to the first driving contact 71*a* of the electric connecting portion 70. Note that the common electrode 62 is formed to have the cutout shape so that the common electrode 62 is not overlapped with the first trace 73*a* in the area between the two second individual electrodes 60*b*. Therefore, no short circuit is formed between the first trace 73*a* and the common electrode 62 in the slit 64 of the piezoelectric film 61.

Further, the first trace 73*a*, which is arranged between the two second individual electrodes 60*b*, has the width in the conveyance direction which is equal to the width in the conveyance direction of the second conductive portion 63*b* of the auxiliary conductor 63 arranged between the two first individual electrodes 60*a*. Note that taking the error brought about when the trace 73 is formed into consideration, the phrase "the width of the first trace 73*a* is equal to that of the second conductive portion 63*h*" in the embodiment of the present invention refers to the fact that the difference (W1-W2) between the width W1 of the first trace 73*a* and the width W2 of the second conductive portion 63*b* is included in a range of not more than 10% of the width W1 of the first trace 73*a*.

As depicted in FIGS. 5 and 6B, the second exposed portion 66 of the second individual electrode 60*b* on the left side is exposed from the edge on the left side of the piezoelectric film 61. The right end portion of the second trace 73*b* corresponding to the second individual electrode 60*b* is formed continuously from the second exposed portion 66 to the upper surface of the piezoelectric film 61. The second trace 73*b* extends leftwardly from the second exposed portion 66 along with the upper surface of the vibration film 57 of the upper substrate 46, and the second trace 73*b* is connected to the second driving contact 71*b* of the electric connecting portion 70.

Figure 7A:
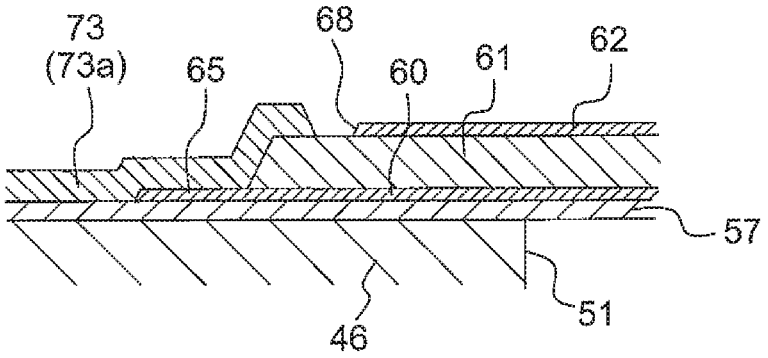
Figure 7B:
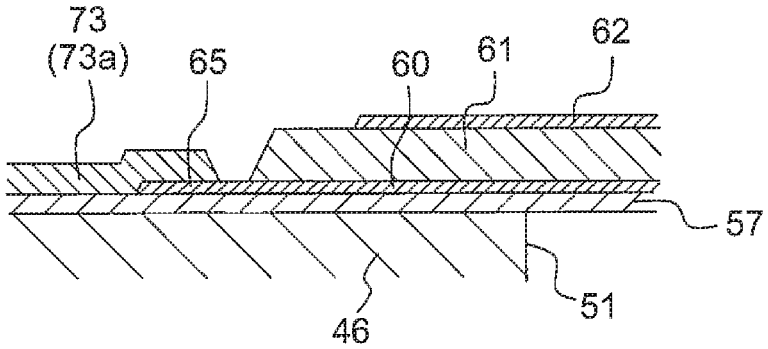

In this embodiment, as depicted in FIG. 7A, the end portion of the first trace 73*a* (second trace 73*b*) is formed continuously from the first exposed portion 65 (second exposed portion 66) via the side surface of the piezoelectric film 61 to the upper surface of the piezoelectric film 61. In this structure, the end portion of the trace 73 is also brought in contact with the upper surface and the side surface of the piezoelectric film 61. Therefore, even if the force, which is directed in the direction to cause the exfoliation from the exposed portion 65 (66), acts on the end portion of the trace 73, the exfoliation from the exposed portion 65 (66) is hardly caused. Therefore, the reliability of the electric connection is enhanced between the end portion of the trace 73 and the exposed portion 65 (66) as compared with a structure in which the end portion of the trace 73 is not overlapped with the piezoelectric film 61 as depicted in FIG. 7B.

Further, the two third conductive portions 63*c* of the auxiliary conductor 63 extend leftwardly from the first conductive portion 63*a* respectively, and the two third conductive portions 63*c* are connected to the ground contacts 72 of the electric connecting portion 70.

The piezoelectric actuator 49 explained above is covered with a protective member 42 arranged on the upper surface of the upper substrate 46. More specifically, the protective member 42 has a recessed cover portion 42*a*, and an opening 42*b* which is formed at a left side portion as compared with the cover portion 42*a*. As depicted in FIG. 4, the opening 42*b* of the protective member 42 is vertically communicated with an opening 40*a* of the holder member 40 positioned thereover. When the protective member 42 is arranged on the upper surface of the upper substrate 46, the cover portion 42*a* covers the piezoelectric film 61 of the piezoelectric actuator 49. On the other hand, the electric connecting portion 70 of the upper substrate 46 is exposed from the opening 42*b* of the protective member 42.

COF 35 is connected to the electric connecting portion 70 of the upper substrate 46. As depicted in FIG. 4, COF 35 extends toward the circuit board 34 disposed at the upward position while meandering in an S-shaped form in the opening 42*b* of the protective member 42 and the opening 40*a* of the holder member 40. A through-hole 34*b*, which is positioned over the opening 40*a* of the holder member 40 and which allows COF 35 to pass therethrough, is formed through the circuit board 34. Further, a connecting terminal 75 is provided on the upper surface of the portion of the circuit board 34 disposed on the right side as compared with the through-hole 34*b*. COF 35, which extends upwardly from the electric connecting portion 70, passes through the through-hole 34*b* of the circuit board 34, and COF 35 is connected to the connecting terminal 75.

Driver IC 76 is provided at an intermediate portion in the upward-downward direction of COF 35. The driver IC 76 is electrically connected to the circuit board 34 via the trace 73 on COF 35. Further, the driver IC 76 is also electrically connected to the driving contact of the electric connecting portion 70 via the trace 73 on COF 35. Then, the driver IC 76 outputs a driving signal to the individual electrode 60 on the basis of a control signal fed from the circuit board 34 so that the electric potential of the individual electrode 60 is switched between the ground electric potential and a predetermined driving electric potential. Note that the ground contact 72 of the electric connecting portion 70 is electrically connected to the ground (not depicted) of COF 35, and the common electrode 62 is retained at the ground electric potential.

An explanation will be made about the operation of the piezoelectric actuator 49 to be performed when the driving signal is supplied from the driver IC 76. In the state in which the driving signal is not supplied, the electric potential of the individual electrode 60 is the ground electric potential, and the electric potential is the same electric potential as that of the common electrode 62. Starting from this state, when the driving signal is supplied to a certain individual electrode 60, and the driving electric potential is applied to the individual electrode 60, then the electric field, which is parallel to the thickness direction, acts on the active portion 61*a* of the piezoelectric film 61 in accordance with the difference in the electric potential between the individual electrode 60 and the common electrode 62. In this situation, the direction of polarization of the active portion 61*a* is coincident with the direction of the electric field. Therefore, the active portion 61*a* is elongated in the thickness direction as the direction of polarization thereof, and the active portion 61*a* is shrunk in the in-plane direction (surface direction). In accordance with the shrinkage deformation of the active portion 61*a*, the vibration film 57 is warped or flexibly bent so that the vibration film 57 protrudes toward the pressure chamber 51. Accordingly, the volume of the pressure chamber 51 is decreased, and the pressure wave is generated in the pressure chamber 51. Thus, the liquid droplets of the ink are discharged from the nozzle 30 communicated with the pressure chamber 51.

Next, an explanation will be made about the steps of producing the head unit 20 described above, especially principally about the steps of producing the piezoelectric actuator 49. In this embodiment, the piezoelectric actuator 49 is produced by sequentially stacking various films by repeating the film formation step and the patterning step on the vibration film 57 of the upper substrate 46.

Figure 8A:
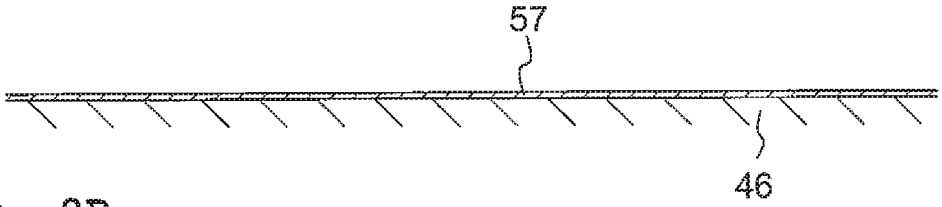
FIG. 8A to 8G depict the steps of producing a piezoelectric actuator.
Figure 8B:
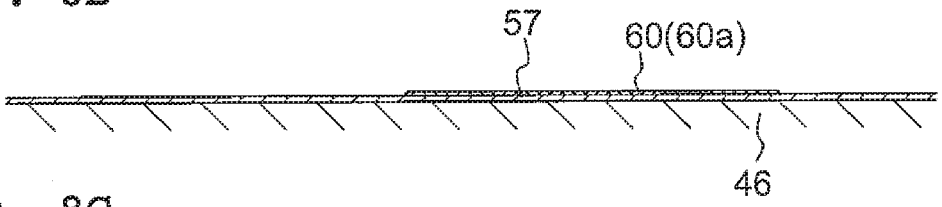

At first, as depicted in FIG. 8A, the vibration film 57 of silicon dioxide or the like is formed as a film by means of, for example, the thermal oxidation on the surface of the upper substrate 46. Subsequently, as depicted in FIG. 8B, a film of platinum is formed by means of, for example, the sputtering on the vibration film 57. This film is etched, and thus the plurality of individual electrodes 60 are formed.

Figure 8C:
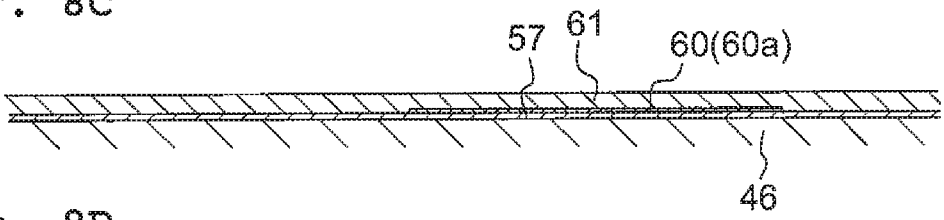
Figure 8D:
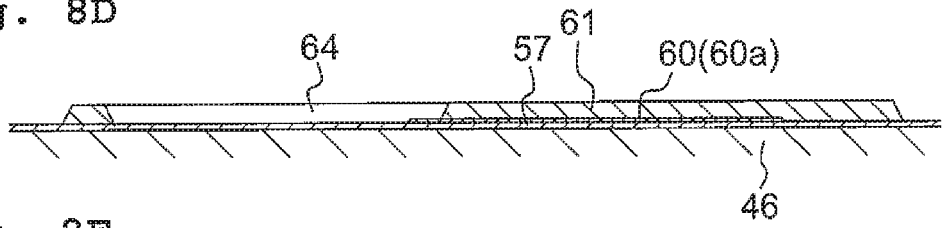

Subsequently, as depicted in FIG. 8C, the piezoelectric film 61 is formed as a film by means of the sol-gel method or the sputtering so that the plurality of individual electrodes 60 are covered therewith on the upper surface of the vibration film 57. Then, as depicted in FIG. 8D, the piezoelectric film 61 is subjected to the pattering by means of the etching. Note that when the piezoelectric film 61 is etched, the slits 64 are formed at the portions of the piezoelectric film 61 disposed between the plurality of first individual electrodes 60*a* and the portions of the piezoelectric film 61 disposed between the plurality of second individual electrodes 60*b*. Simultaneously, the portions of the piezoelectric film 61, which cover the left end portions of the first individual electrodes 60*a*, are removed by means of the etching, and the portions are exposed from the piezoelectric film 61 to form the first exposed portions 65.

Figure 8E:
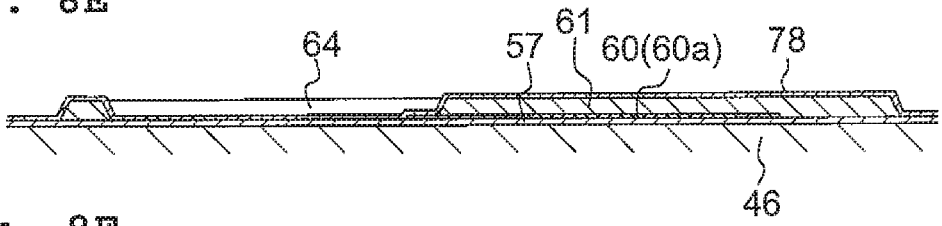
Figure 8F:
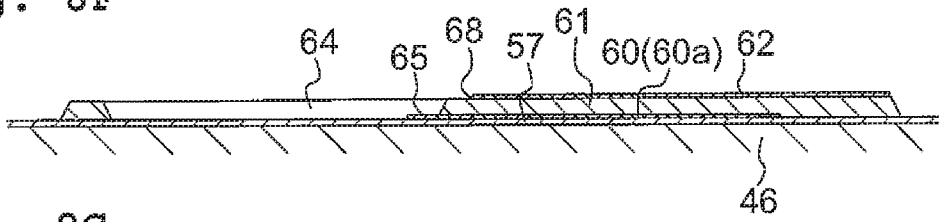

After the pattering of the piezoelectric film 61, a metal film 78 of iridium or the like, which serves as the common electrode 62, is formed as a film by means of, for example, the sputtering on the upper surface of the piezoelectric film 61 as depicted in FIG. 8E. Subsequently, as depicted in FIG. 8F, the metal film 78 is subjected to the pattering by means of the etching to form the common electrode 62. When the pattering is performed for the common electrode 62, the cutouts 68, each of which is cut out from the left side, are formed in the areas of the common electrode 62 disposed between the plurality of second individual electrodes 60*b*.

Figure 8G:
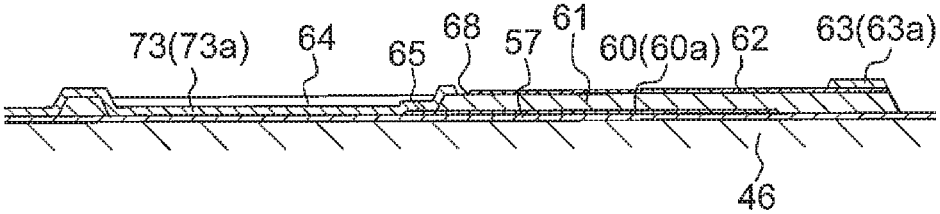

Subsequently, as depicted in FIG. 8G, the traces 73, which are connected to the exposed portions 65 (66) of the individual electrodes 60, are formed. In this case, the trace 73 is formed so that the right end portion thereof continuously extends from the exposed portion 65 (66) via the side surface of the piezoelectric film 61 to the upper surface. Further, in this procedure, the auxiliary conductor 63 is formed on the piezoelectric film 61 (common electrode 62) by means of the same film formation process as that for the trace 73.

When the traces 73 and the auxiliary conductor 63 are formed of gold, it is preferable that the film is formed by means of the plating method. At first, a mask based on a photoresist is formed in the area in which the plurality of traces 73 and the auxiliary conductor 63 are not formed. Subsequently, the film of gold is formed on the mask by means of the plating. After that, the mask is exfoliated, and thus the plurality of traces 73 and the auxiliary conductor 63 are arranged in the area not covered with the mask. On the other hand, when the traces 73 and the auxiliary conductor 63 are formed of aluminum, a conductive film of aluminum is formed in an approximately entire region of the upper surface of the upper substrate 46 by means of, for example, the sputtering. Subsequently, the etching is performed for the conductive film to remove unnecessary portions, and thus the plurality of traces 73 and the auxiliary conductor 63 are formed. In this way, the plurality of traces 73 and the auxiliary conductor 63 are formed of the same material by means of the same film formation process. Therefore, it is possible to form the traces 73 and the auxiliary conductor 63 at the same time. Further, the thickness of the traces 73 can be easily made equal to the thickness of the auxiliary conductor 63 as well.

The production of the piezoelectric actuator 49 is completed as described above. After that, the steps are successively performed, for example, for the joining of the protective member 42, the formation of the pressure chambers 51 by means of the etching for the upper substrate 46, the joining of the intermediate substrate 47 and the lower substrate 48, and the connection of COF 35.

As explained above, in this embodiment, both of the first trace 73*a* connected to the first individual electrode 60*a* and the second trace 73*b* connected to the second individual electrode 60*b* extend leftwardly, and they are connected to the driving contacts 71*a*, 71*b* of the electric connecting portion 70. In the case of this structure, the ground contact 72 and the driving contacts 71*a*, 71*b* of the electric connecting portion 70 are not arranged between the plurality of first individual electrodes 60*a* and the plurality of second individual electrodes 60*b*. Therefore, it is possible to narrow the distance in the scanning direction between the first pressure chamber 51*a* and the second pressure chamber 51*b*. Accordingly, it is also possible to decrease the distance in the scanning direction between the nozzles 30 communicated with the first pressure chambers 51*a* (nozzle array 31 disposed on the right side) and the nozzles 30 communicated with the second pressure chambers 51*b* (nozzle array 31 disposed on the left side).

Note that if the distance between the two nozzle arrays 31 of each of the head units 20 is large, various problems arise as follows. At first, with reference to FIG. 2, the distance in the scanning direction is increased between the nozzle array 31*y*1 positioned at the left end and the nozzle array 31*y*2 positioned at the right end in relation to the entire ink-jet head 4 having the four head units 20. Accordingly, the distance of movement, which is provided in one path, is lengthened when the printing is performed on the recording paper 100 by using both of the nozzle array 31*y*1 at the left end and the nozzle array 31*y*2 at the right end while reciprocatively moving the ink-jet head 4 in the scanning direction. Therefore, the time, which is required for one path, is prolonged, and the time, which is required for the printing on one sheet of the recording paper 100 is also prolonged. Further, if the distance between the two nozzle arrays 31 of one head unit 20 is increased to cause separation, the width in the scanning direction of the lower substrate 48 of each of the head units 20 is also increased, which results in the increase in the cost.

Further, it is ideal that the respective head units 20 of the ink-jet head 4 are attached so that the arrangement direction of the nozzles 30 (extending direction of the nozzle array 31) is completely parallel to the conveyance direction. However, actually, the respective head units 20 are attached in many cases as well in such a state that the arrangement direction of the nozzles 30 is slightly inclined with respect to the conveyance direction. In such a situation, the landing positions of the liquid droplets of the inks discharged from the nozzles 30 are deviated in the conveyance direction between the two nozzle arrays 31 resulting from the inclination as described above. In this case, the larger the distance in the scanning direction between the two nozzle arrays 31 is, the larger the deviation of the landing position between the two nozzle arrays 31 is.

In relation thereto, in this embodiment, it is possible to decrease the distance between the two nozzle arrays 31 of each of the head units 20. Therefore, it is possible to suppress the various problems as described above.

In the meantime, the individual electrode 60 is the electrode which is covered with the piezoelectric film 61. Therefore, it is also possible to adopt such a structure that the trace 73, which is connected to the individual electrode 60, is arranged under or below the piezoelectric film 61. In this case, the trace 73 is formed previously, and then the piezoelectric film 61 is formed as a film thereon. However, if the trace 73 is formed previously before the film formation of the piezoelectric film 61, for example, the following problem may arise.

At first, if the trace 73 is formed before the film formation of the piezoelectric film 61, it is feared that the orientation of the piezoelectric film 61 to be formed later on may be changed depending on the material of the trace 73. In order to suppress this inconvenience, it is necessary that the trace 73 should be formed of a material such as platinum (Pt) or the like having little fear of exerting any influence on the orientation of the piezoelectric film 61. In other words, restriction appears in relation to the selection of the material of the trace 73, and it is difficult to use a material which is more inexpensive than platinum or a material which has a low electric resistivity. Further, it is desirable that the thickness of the trace 73 is large in order to decrease the electric resistance of the trace 73. However, the following problem also arises. That is, if the piezoelectric film 61 is formed as a film after forming the trace 73 having the large thickness, the unevenness of film formation (unevenness of thickness) arises in the piezoelectric film 61.

In relation thereto, in this embodiment, the piezoelectric film 61 is formed as the film, and then the trace 73 is formed. Thus, the trace 73 is formed continuously from the exposed portion 65 (66) of the individual electrode 60 to the upper surface of the piezoelectric film 61. In this way, the trace 73 is formed after the film formation of the piezoelectric film 61, and thus no problem arises concerning the unevenness of film formation and the change of the orientation of the piezoelectric film 61 as mentioned above. Therefore, the degree of freedom of the design is raised, for example, in relation to the material and the shape of the trace 73. For example, the trace 73 can be formed of gold or aluminum in view of the fact that the electric resistance of the trace 73 is decreased and/or it is intended to decrease the cost. Further, in order to decrease the electric resistance of the trace 73, the thickness of the trace 73 can be made considerably large as compared with the thickness of the individual electrode 60. Further, the trace 73 is arranged continuously from the exposed portion 65 (66) to the upper surface of the piezoelectric film 61. Owing to this fact, as explained with reference to FIG. 7, the conduction reliability is raised between the trace 73 and the exposed portion as compared with the structure in which the trace 73 does not override the piezoelectric film 61.

Further, in this embodiment, the common electrode 62, which covers the piezoelectric film 61, has the cutout shape cut out from the left between the two second individual electrodes 60*b*. Therefore, the first trace 73*a*, which is formed on the piezoelectric film 61, can be arranged between the two second individual electrodes 60*b* without being brought in contact with the common electrode 62. Note that in this embodiment, the slit 64 is formed at the portion of the piezoelectric film 61 between the two second individual electrodes 60*b*. However, the common electrode 62 is formed to have the cutout shape in this area. Accordingly, any short circuit formation is avoided between the first trace 73*a* and the common electrode 62 in the slit 64.

As depicted in FIGS. 5A and 5B, in this embodiment, the auxiliary conductor 63, which is brought in contact with the common electrode 62, is arranged on the common electrode 62. Owing to the auxiliary conductor 63, the difference in the electric potential is decreased between the two different portions of the common electrode 62. As a result, the dispersion of the applied voltage applied to the piezoelectric film 61 (voltage between the individual electrode 60 and the common electrode 62) is suppressed between the plurality of pressure chambers 51.

In the first place, the first conductive portion 63*a* of the auxiliary conductor 63 extends in the conveyance direction on the right side as compared with the plurality of first individual electrodes 60*a*. That is, the first conductive portion 63*a* is arranged to connect the two portions of the common electrode 62 separated from each other in the conveyance direction. Accordingly, the dispersion of the applied voltage applied to the piezoelectric film 61 is suppressed between the plurality of first pressure chambers 51*a* arranged in the conveyance direction. Further, all of the traces 73 (73*a*, 73*b*) connected to the individual electrodes 60 extend to the left side (side of the second individual electrodes 60*b*). Therefore, the first conductive portion 63*a*, which extends in the conveyance direction, can be arranged on the side of the first individual electrodes 60*a* opposite to the second individual electrodes 60*b*.

Each of the second conductive portions 63*b* of the auxiliary conductor 63 extends in the scanning direction between the two first individual electrodes 60*a* which adjoin in the conveyance direction. Further, the second conductive portions 63*b* are provided on the common electrode 62, and the second conductive portions 63*b* are brought in contact with the common electrode 62. Accordingly, the current routes, which are formed by the first conductive portion 63*a* and the second conductive portions 63*b* of the auxiliary conductor 63, are increased in addition to the current routes formed by the common electrode 62 itself for the electrode portions of the common electrode 62 opposed to the respective first pressure chambers 51*a*. Therefore, the difference in the electric potential is decreased among the electrode portions of the common electrode 62 opposed to the pressure chambers 51, between the first pressure chambers 51*a* disposed at the positions far from the ground contacts 72 and the second pressure chambers 51*b* disposed near to the ground contacts 72. The dispersion of the applied voltage applied to the piezoelectric film 61 is suppressed.

Further, the first trace 73*a* is arranged between the two adjoining second individual electrodes 60*b*, while the second conductive portion 63*b* is also arranged between the two adjoining first individual electrodes 60*a*. Accordingly, the condition concerning the deformation of the piezoelectric film 61 can be approximated between the first pressure chamber 51*a* and the second pressure chamber 51*b*. It is possible to decrease the difference in the deformation characteristic of the piezoelectric film 61 between the first pressure chamber 51*a* and the second pressure chamber 51*b*.

In view of the fact that the condition concerning the deformation of the piezoelectric film 61 is further approximated between the first pressure chamber 51*a* and the second pressure chamber 51*b*, the width of the first trace 73*a* passing between the two second individual electrodes 60*b* is equal to the width of the second conductive portion 63*b* arranged between the two first individual electrodes 60*a*. Further, the auxiliary conductor 63 (second conductive portion 63*b*) is formed of the same material as that of the first trace 73*a*. Further, the thickness of the auxiliary conductor 63 (second conductive portion 63*b*) is the same as that of the first trace 73*a*.

Further, the third conductive portions 63*c* of the auxiliary conductor 63 extend leftwardly from the first conductive portion 63*a* on the front side and the back side as compared with the plurality of individual electrodes 60. Further, the third conductive portions 63*c* are connected to the ground contacts 72 of the electric connecting portion 70. Therefore, owing to the third conductive portions 63*c* and the first conductive portion 63*a* described above, the current routes are increased between the electrode portions of the common electrode 62 opposed to the first pressure chambers 51*a* and the ground contacts 72 of the electric connecting portion 70. Therefore, the difference in the applied voltage applied to the piezoelectric film 61 can be further suppressed to be small between the first pressure chambers 51*a* disposed at the positions far from the ground contacts 72 and the second pressure chambers 51*b* disposed at the positions near to the ground contacts 72.

In the embodiment explained above, the ink-jet head 4 corresponds to the "liquid discharge apparatus" according to the present teaching. The upper substrate 46 corresponds to the "channel substrate" according to the present teaching. The first driving contact 71*a* corresponds to the "first contact" according to the present teaching. The second driving contact 71*b* corresponds to the "second contact" according to the present teaching. The ground contact 72 corresponds to the "third contact" according to the present teaching.

Next, an explanation will be made about modified embodiments in which various modifications are applied to the embodiment described above. However, those constructed in the same manner as those of the embodiment described above are designated by the same reference numerals, any explanation of which will be appropriately omitted.

Figure 9A:
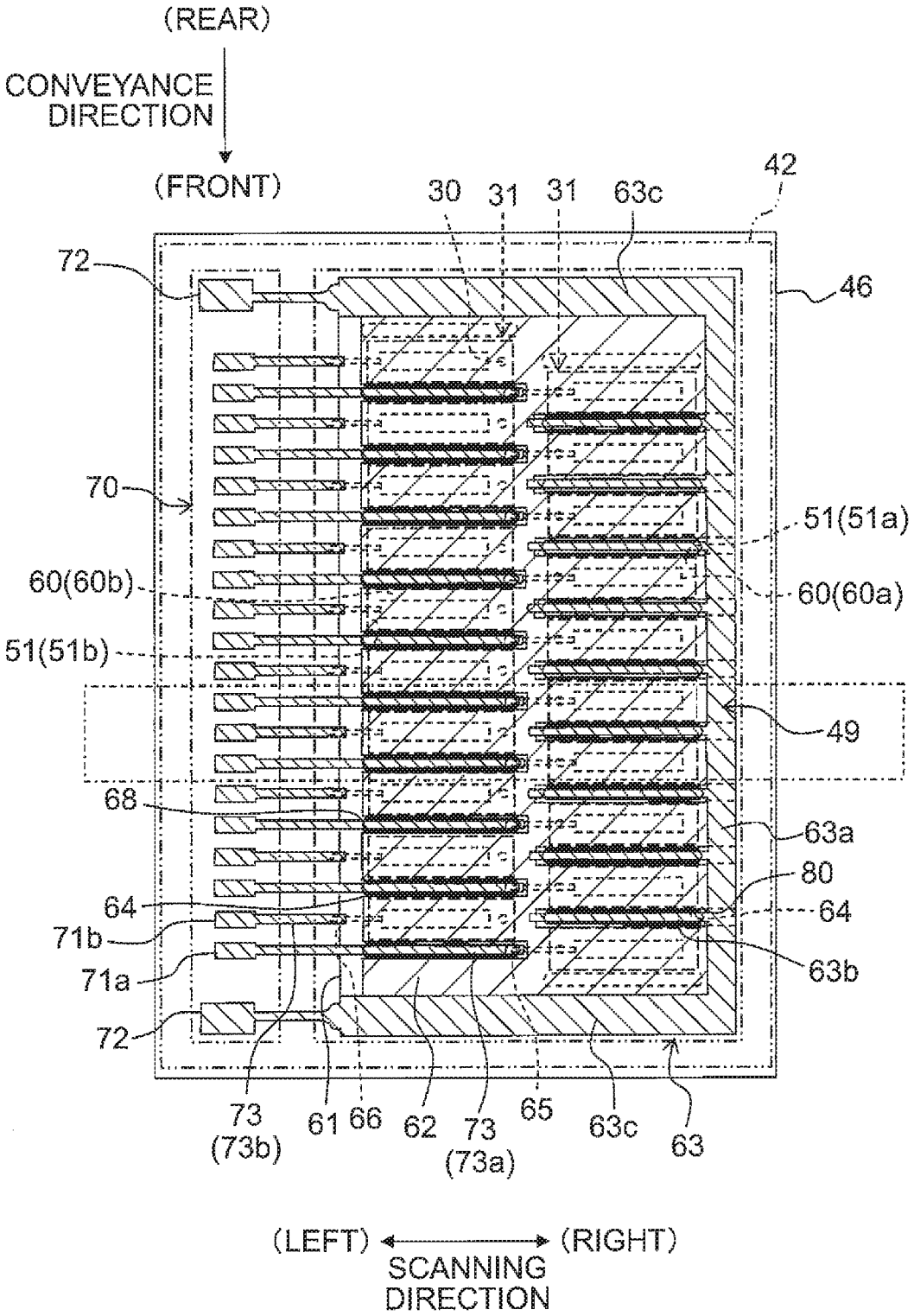
FIG. 9A depicts a top view illustrating a main head body of a head unit according to a modified embodiment.
Figure 9B:
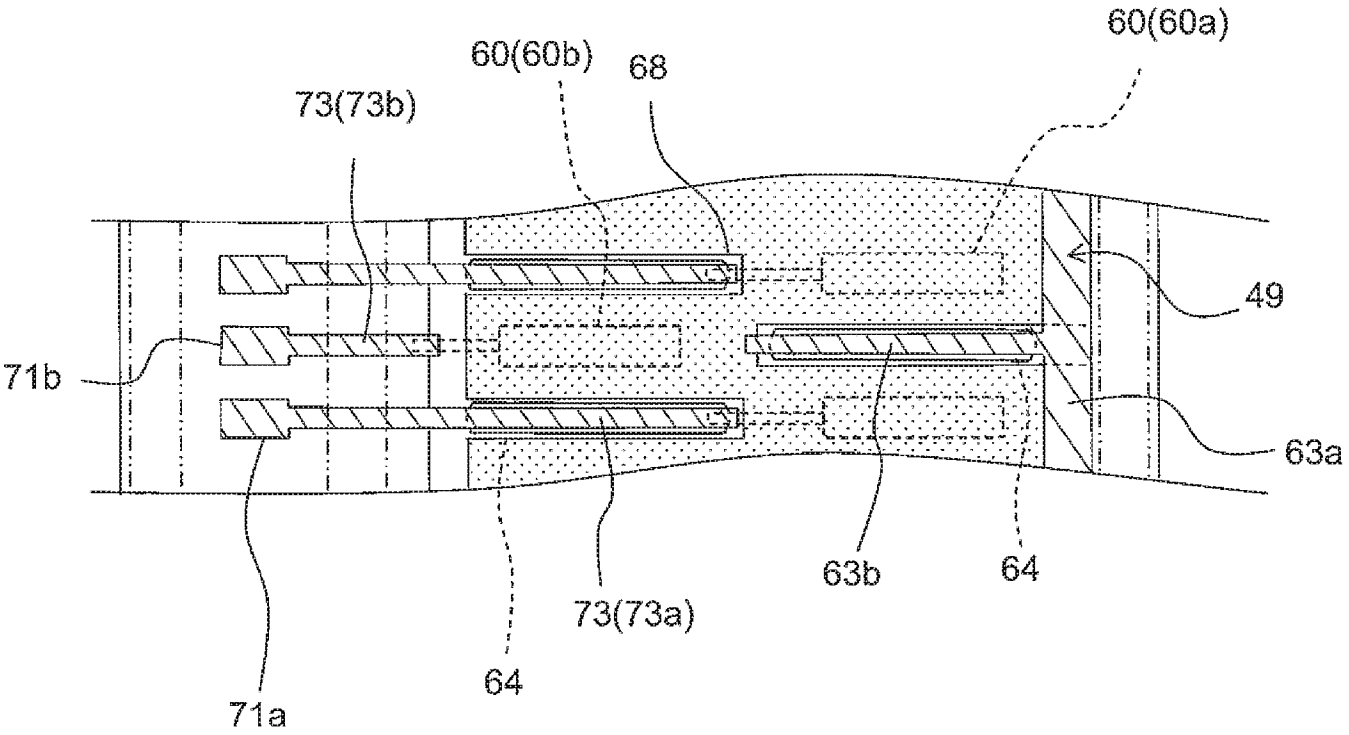
FIG. 9B depicts an enlarged view of a region enclosed by the one-dot chain line depicted in FIG. 9A.

An opening may be also formed in an area of the common electrode 62 disposed between the two first individual electrodes 60*a* which adjoin in the conveyance direction, and the piezoelectric film 61 may be partially exposed from the common electrode 62. With reference to FIGS. 9A and 9B, a cutout 80, which is cut out from the right side, is formed between the portions of the right side portion of the common electrode 62 opposed to the two first individual electrodes 60*a* which adjoin in the conveyance direction. Accordingly, the right side portion of the common electrode 62 is formed to have a comb-shaped form extending leftwardly from the central portion of the common electrode 62 in the same manner as the left side portion. Then, the second conductive portion 63*b* of the auxiliary conductor 63 is arranged in the area of the common electrode 62 in which the cutout 80 is formed. The forward end portion of the second conductive portion 63*b* further extends leftwardly beyond the bottom portion of the cutout 80, and the second conductive portion 63*b* is brought in contact with the common electrode 62.

In the first place, with reference to FIGS. 9A and 9B, the first trace 73*a* is arranged in the area of the common electrode 62 in which the cutout 68 is formed between the two second individual electrodes 60*b*, in the same manner as the embodiment described above. In addition thereto, the second conductive portion 63*b* is arranged in the area of the common electrode 62 in which the cutout 80 is formed between the two first individual electrodes 60*a*. In other words, the first trace 73*a* is directly formed on the upper surface of the piezoelectric film 61 between the two second individual electrodes 60*b*, and the second conductive portion 63*b* is directly formed on the upper surface of the piezoelectric film 61 between the two first individual electrodes 60*a*. Owing to this structure, the condition concerning the deformation of the piezoelectric film 61 is further approximated between the first pressure chamber 51*a* and the second pressure chamber 51*b*. Therefore, it is possible to further decrease the difference in the deformation characteristic of the piezoelectric film 61 between the both. Further, in view of the fact that the condition concerning the deformation of the piezoelectric film 61 is further approximated between the first pressure chamber 51*a* and the second pressure chamber 51*b*, the length of the cutout 68 disposed on the left side can be made equal to the length of the cutout 80 disposed on the right side, and the width of the cutout 68 disposed on the left side can be made equal to the width of the cutout 80 disposed on the right side.

Figure 10A:
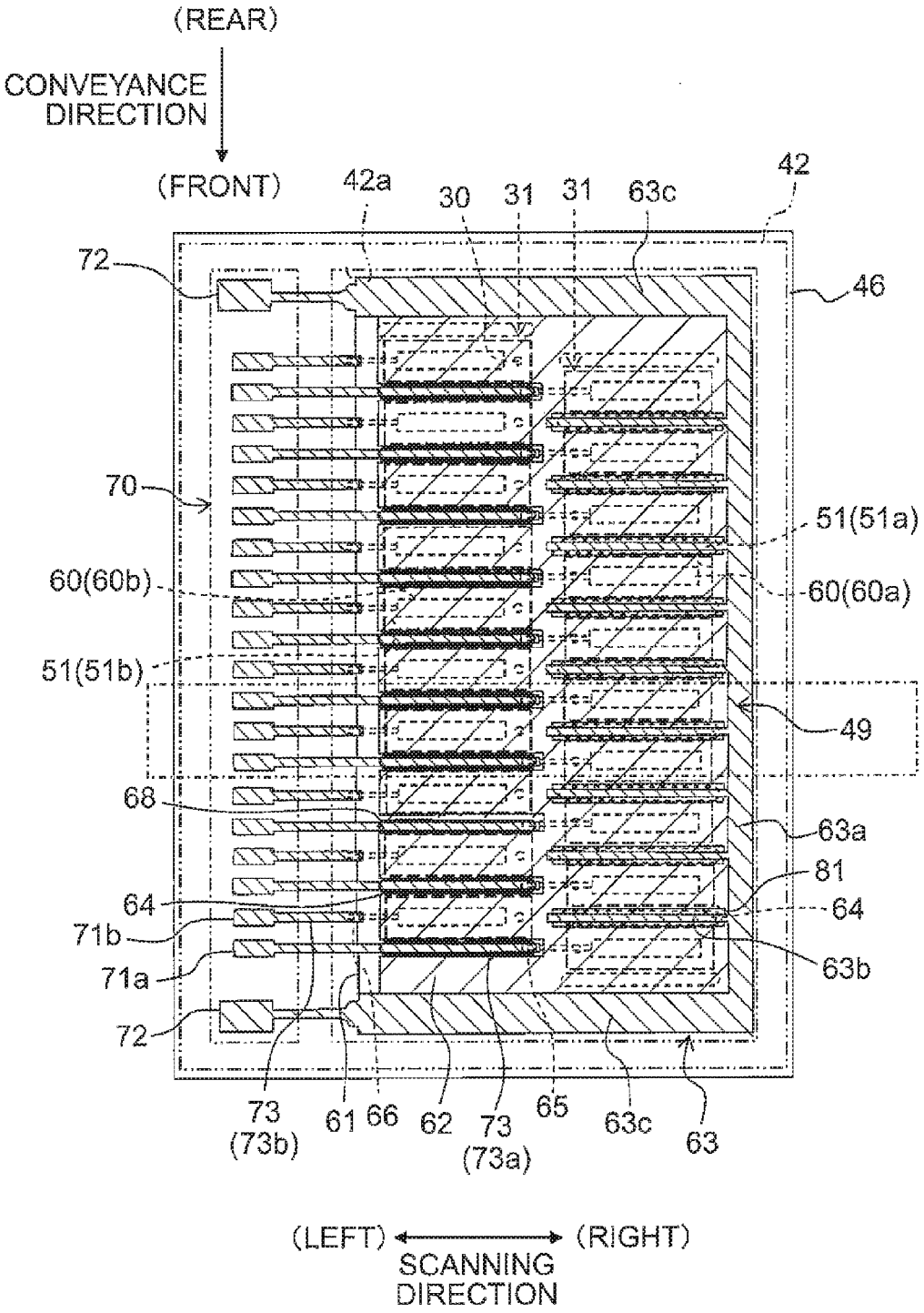
FIG. 10A depicts a top view illustrating a head unit according to another modified embodiment.
Figure 10B:
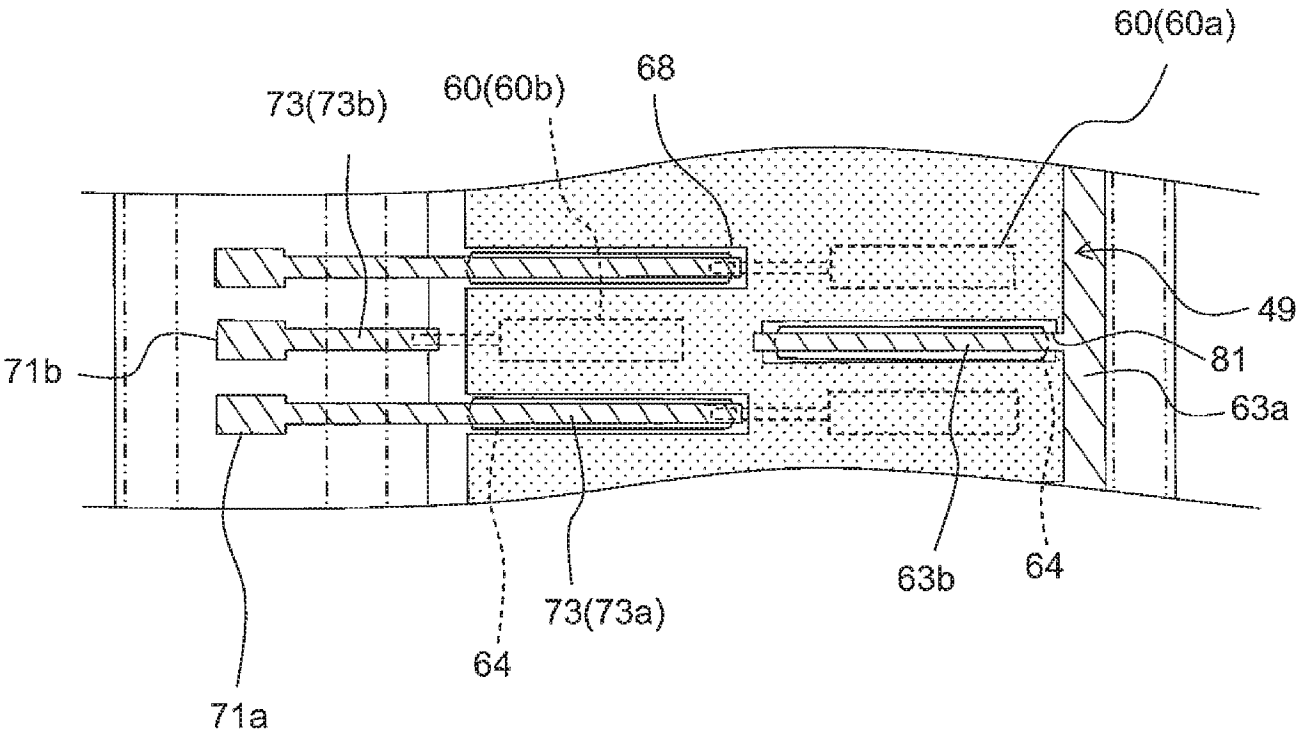
FIG. 10B depicts an enlarged view of a region enclosed by the one-dot chain line depicted in FIG. 10A.

Note that in FIGS. 9A and 9B, the opening having the cutout shape, in which the edge on the right side is not provided, is formed at the portion of the common electrode 62 disposed between the two first individual electrodes 60*a*. However, as depicted in FIGS. 10A and 10B, it is also allowable that a bore-shaped opening 81, which has the edge on the entire circumference, is formed.

The auxiliary conductor 63, which is brought in contact with the common electrode 62, is not limited to one having the structure of the embodiment described above, for which it is also possible to adopt the following structure.

Figure 11A:
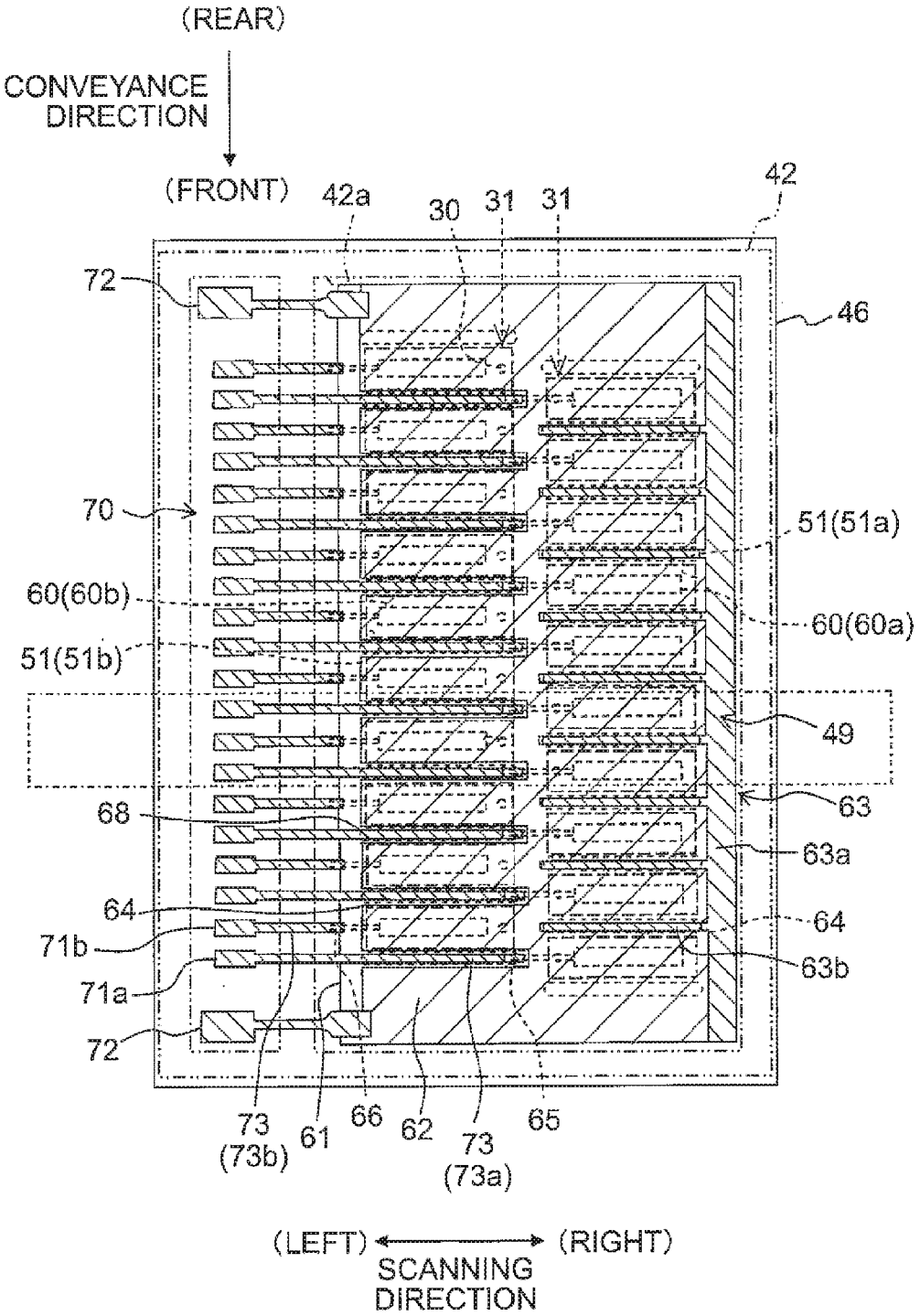
FIG. 11A depicts a top view illustrating a head unit according to still another modified embodiment.
Figure 11B:
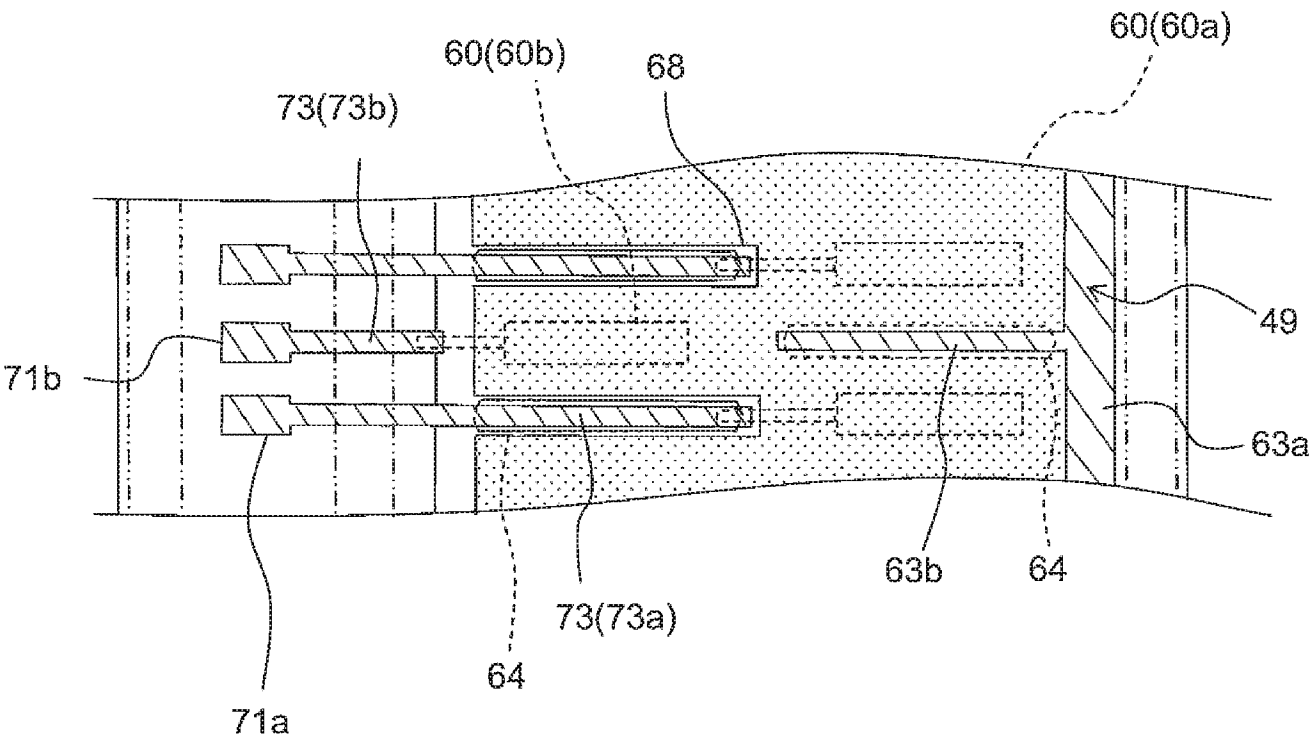
FIG. 11B depicts an enlarged view of a region enclosed by the one-dot chain line depicted in FIG. 11A.
Figure 12A:
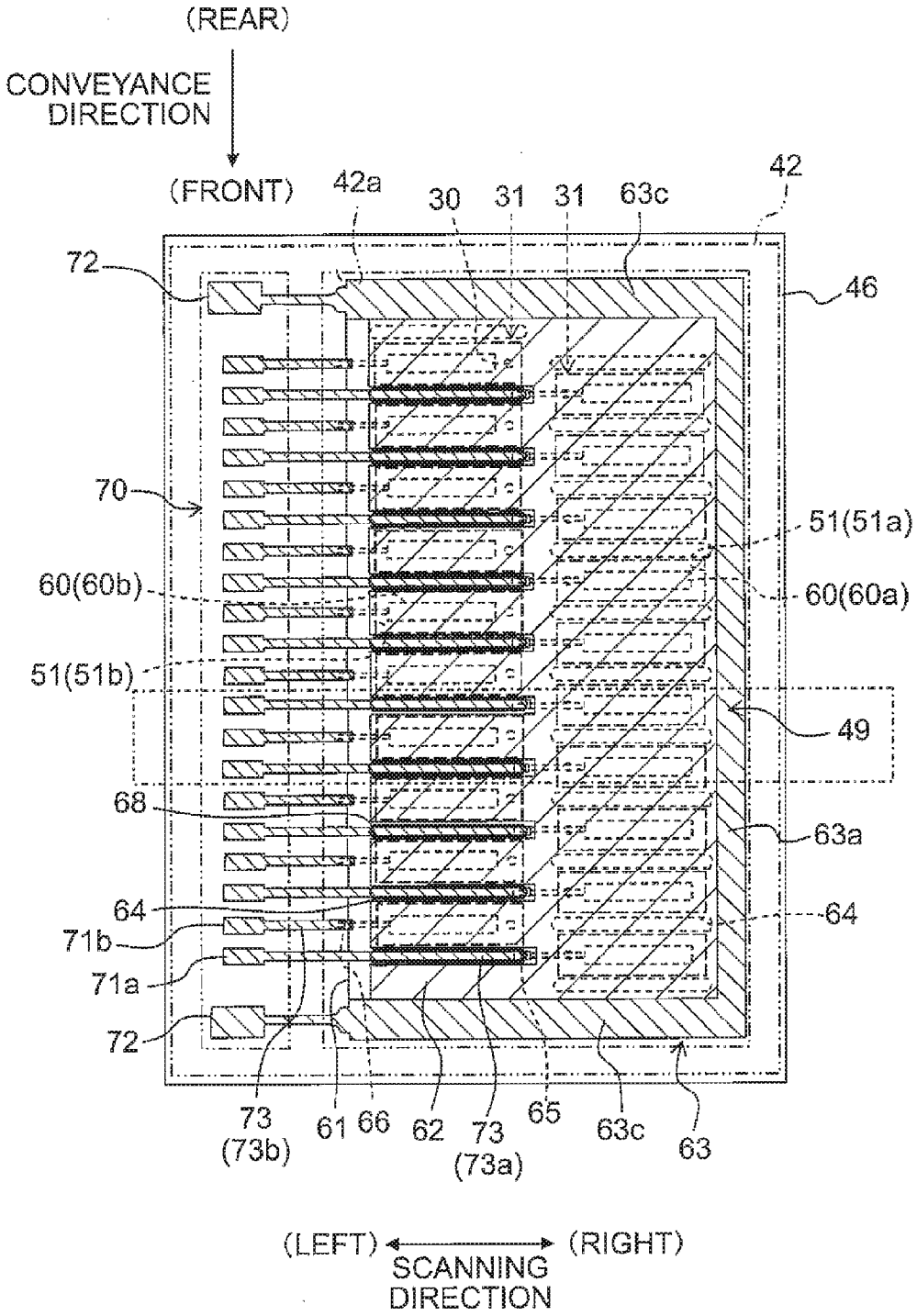
FIG. 12A depicts a top view illustrating a head unit according to still another modified embodiment.
Figure 12B:
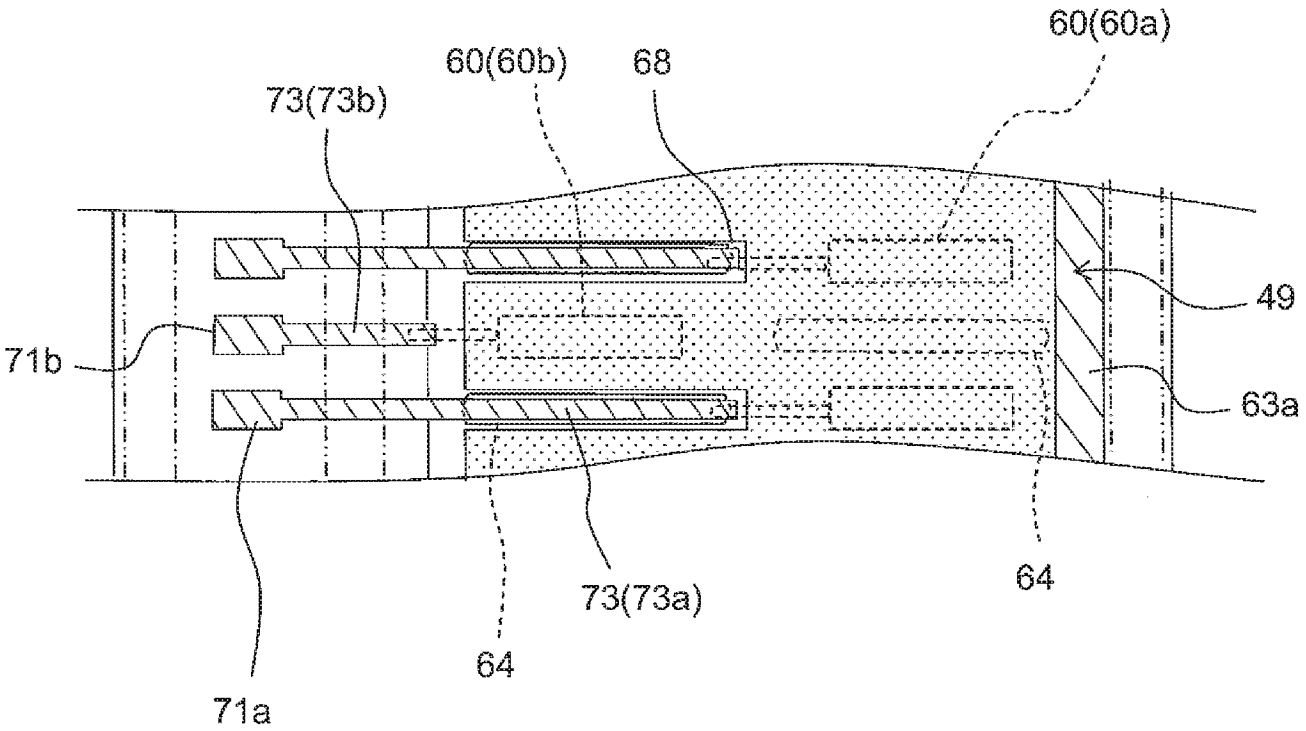
FIG. 12B depicts an enlarged view of a region enclosed by the one-dot chain line depicted in FIG. 12A.
Figure 13A:
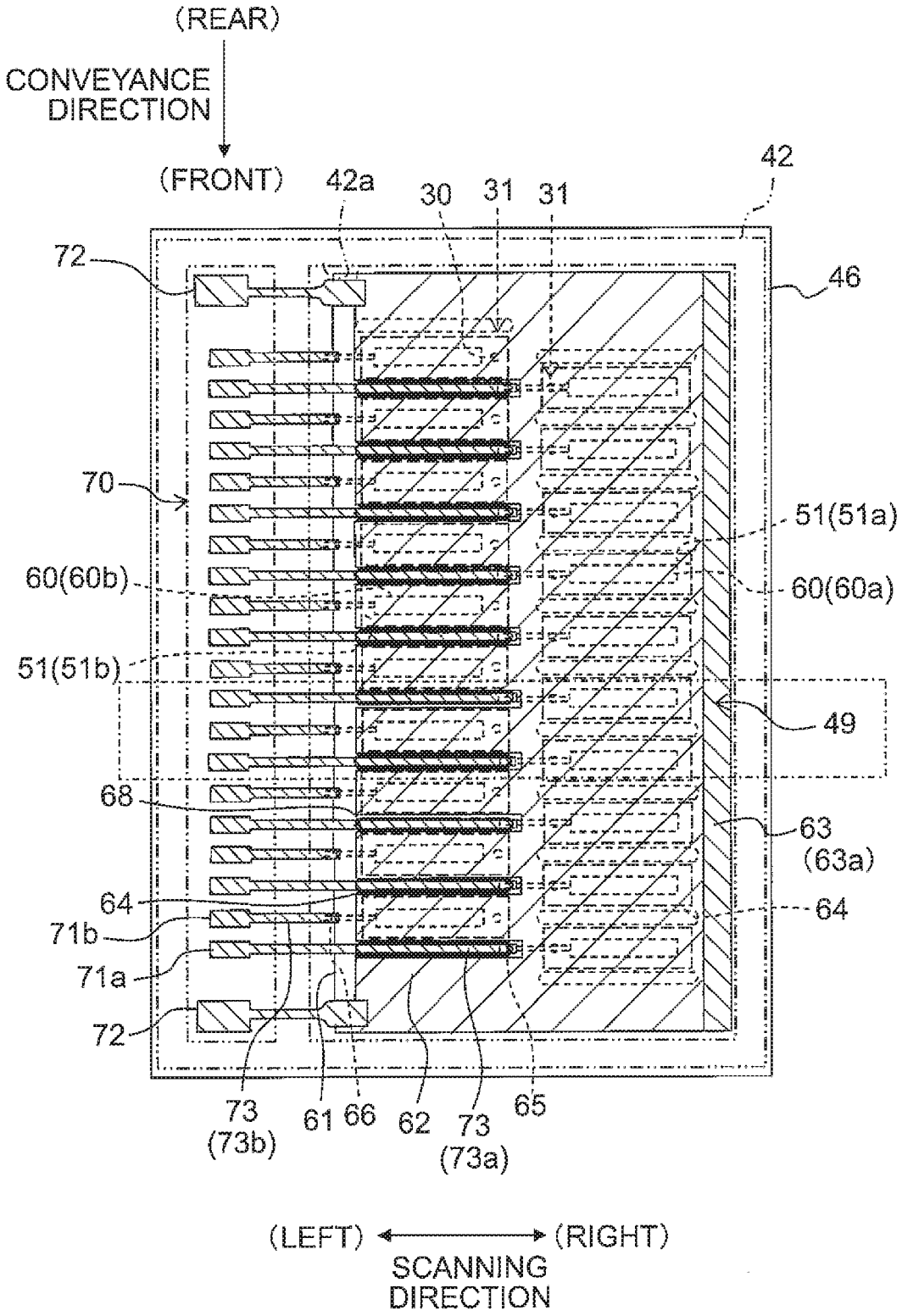
FIG. 13A depicts a top view illustrating a head unit according to still another modified embodiment.
Figure 13B:
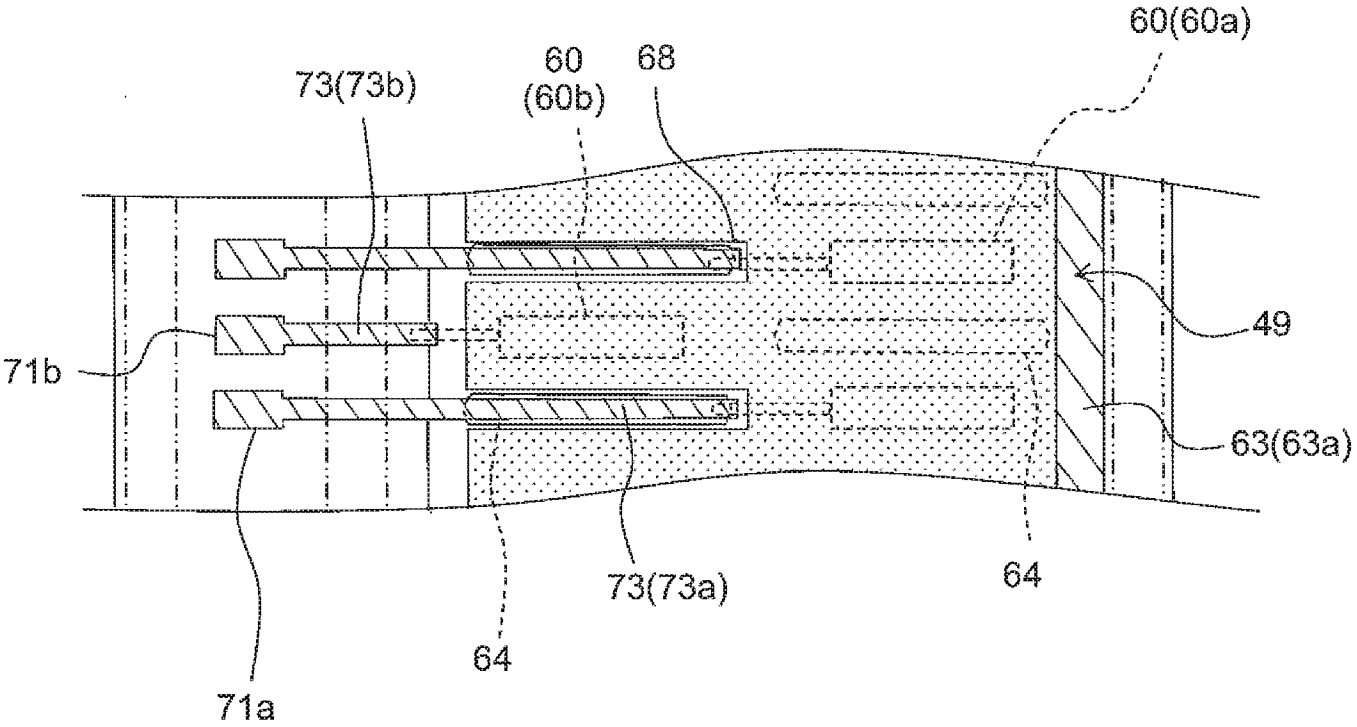
FIG. 13B depicts an enlarged view of a region enclosed by the one-dot chain line depicted in FIG. 13A.

As depicted in FIGS. 11A and 11B, the auxiliary conductor 63 may have such a structure that the auxiliary conductor 63 has the first conductive portion 63*a* and the second conductive portions 63*b* and the auxiliary conductor 63 does not have the third conductive portions 63*c*. Alternatively, as depicted in FIGS. 12A and 12B, the auxiliary conductor 63 may have such a structure that the auxiliary conductor 63 has the first conductive portion 63*a* and the third conductive portions 63*c* and the auxiliary conductor 63 does not have the second conductive portions 63*b*. Further alternatively, as depicted in FIGS. 13A and 13B, the auxiliary conductor 63 may have such a structure that the auxiliary conductor 63 has only the first conductive portion 63*a* extending in the conveyance direction.

Figure 14A:
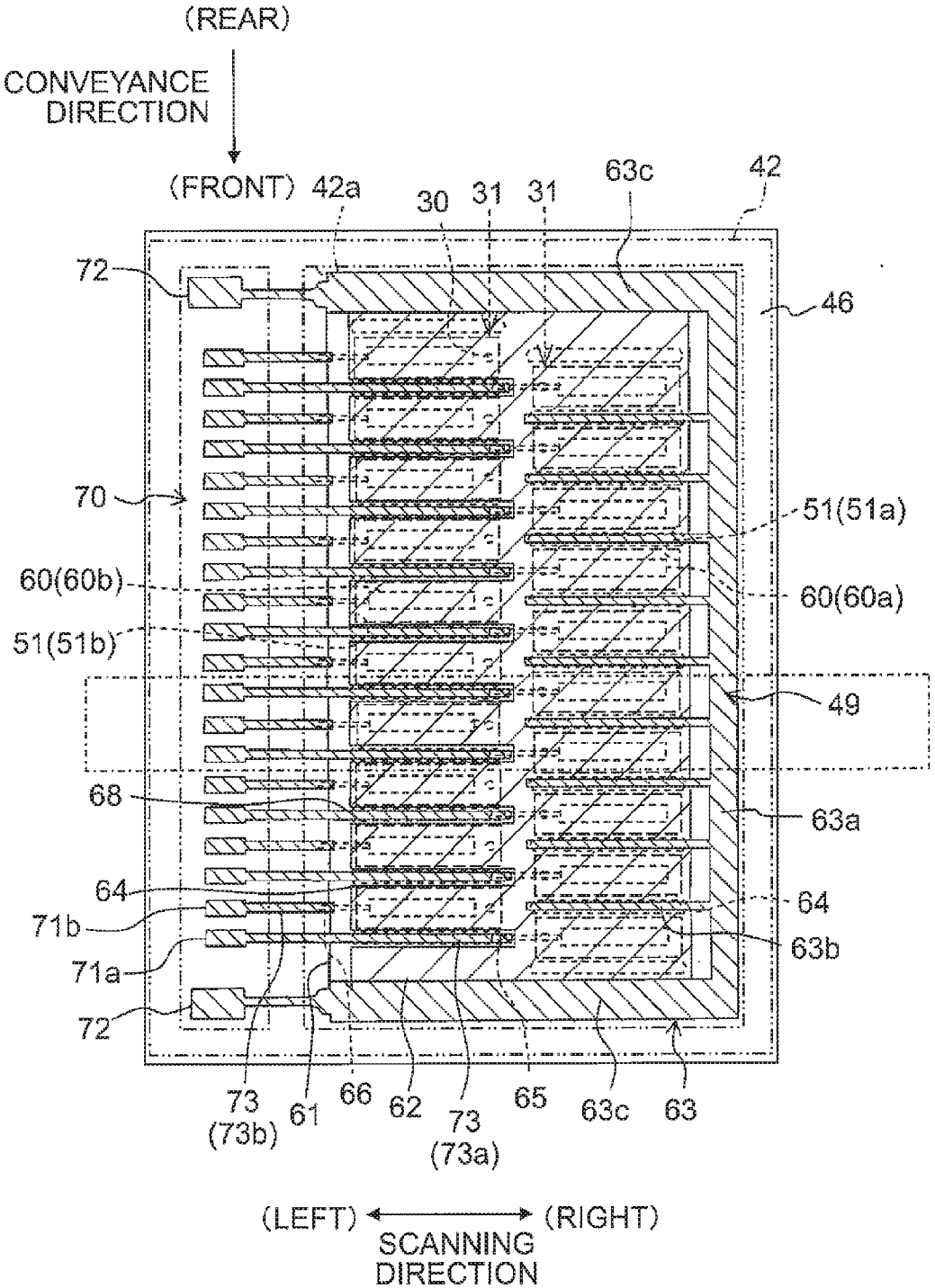
FIG. 14A depicts a top view illustrating a head unit according to still another modified embodiment.
Figure 14B:
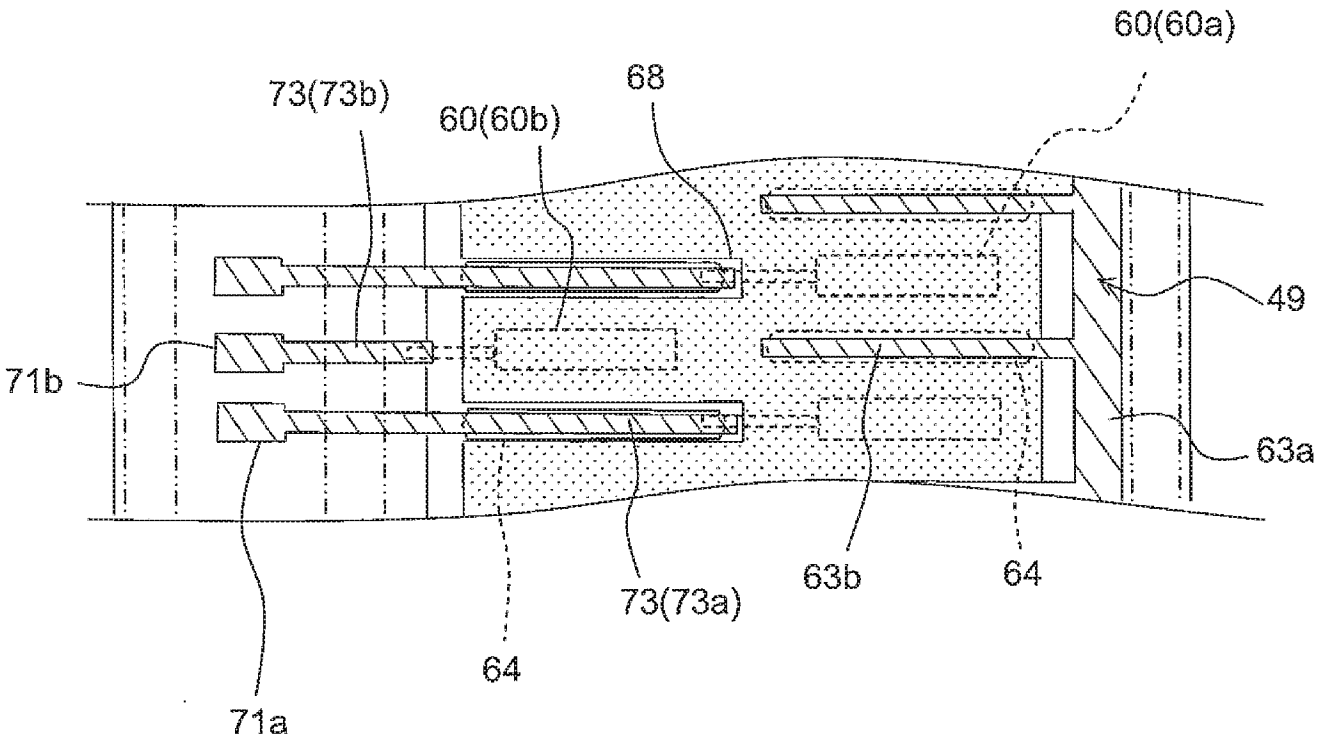
FIG. 14B depicts an enlarged view of a region enclosed by the one-dot chain line depicted in FIG. 14A.

In the embodiment described above, the auxiliary conductor 63 is arranged on the common electrode 62, and the entire auxiliary conductor 63 is brought in contact with the common electrode 62. However, it is also allowable that the auxiliary conductor 63 is brought in contact with only a part of the common electrode 62. For example, with reference to FIGS. 14A and 14B, the first conductive portion 63*a* of the auxiliary conductor 63 is brought in contact with the common electrode 62 at only the both end portions in the conveyance direction. The other portions are arranged on the right side from the common electrode 62, and they are not brought in contact with the common electrode 62.

Figure 15A:
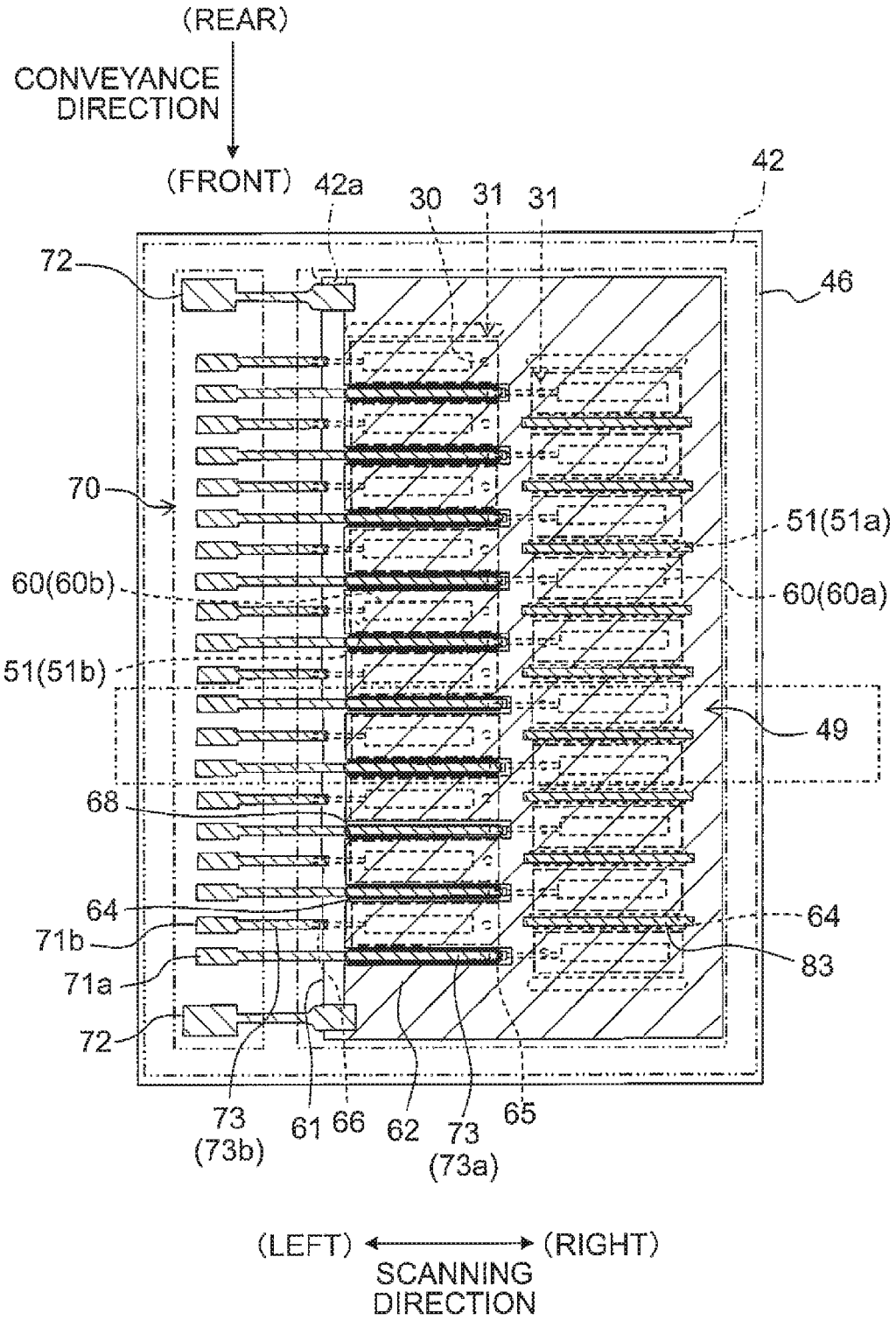
FIG. 15A depicts a top view illustrating a head unit according to still another modified embodiment.
Figure 15B:
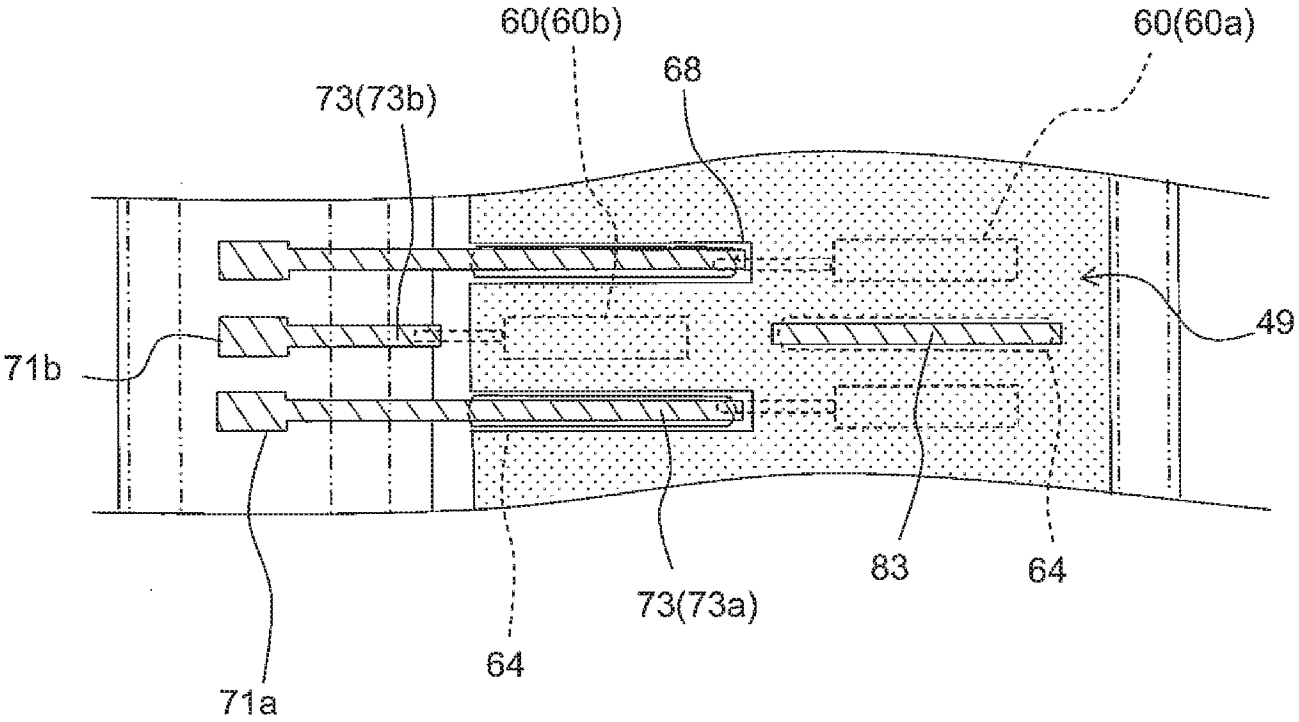
FIG. 15B depicts an enlarged view of a region enclosed by the one-dot chain line depicted in FIG. 15A.

Further, as depicted in FIGS. 15A and 15B, it is also allowable that each of auxiliary conductors 83 is arranged only between the two first individual electrodes 60*a* on the common electrode 62. The auxiliary conductor 83 extends in the scanning direction between the two first individual electrodes 60*a*, and the auxiliary conductor 83 connects the two portions of the common electrode 62 separated from each other in the scanning direction.

When the auxiliary conductor 83 depicted in FIGS. 15A and 15B is used, the effect is thereby obtained, which is the same as or equivalent to that of the second conductive portion 63*b* of the embodiment described above. The current routes, which are provided by the auxiliary conductors 83, are increased in addition to the current routes provided by the common electrode 62 itself for the electrode portions opposed to the respective first pressure chambers 51*a*. Therefore, the difference in the electric potential of the electrode portion of the common electrode 62 opposed to the pressure chamber 51 is decreased between the first pressure chambers 51*a* and the second pressure chambers 51*b*. The dispersion of the applied voltage applied to the piezoelectric film 61 is suppressed. Further, the first trace 73*a* is arranged between the two adjoining second individual electrodes 60*b*, while the auxiliary conductor 83 is arranged between the two adjoining first individual electrodes 60*a*. Accordingly, the condition concerning the deformation of the piezoelectric film 61 can be approximated between the first pressure chamber 51*a* and the second pressure chamber 51*b*, and it is possible to decrease the difference in the characteristic of the piezoelectric film 61.

Further, also in the embodiment depicted in FIGS. 15A and 15B, in view of the fact that the condition concerning the deformation of the piezoelectric film 61 is approximated between the first pressure chamber 51*a* and the second pressure chamber 51*b*, the width of the first trace 73*a* passing between the two second individual electrodes 60*b* can be made equal to the width of the auxiliary conductor 83 arranged between the two first individual electrodes 60*a*. Further, the auxiliary conductor 83 and the first trace 73*a* can be formed of the same material. Further, the thickness of the auxiliary conductor 83 can be made the same as that of the first trace 73*a*.

It is not necessarily indispensable that the auxiliary conductor is provided for the common electrode 62. That is, it is also allowable that only the common electrode 62 is arranged on the piezoelectric film 61.

Figure 16A:
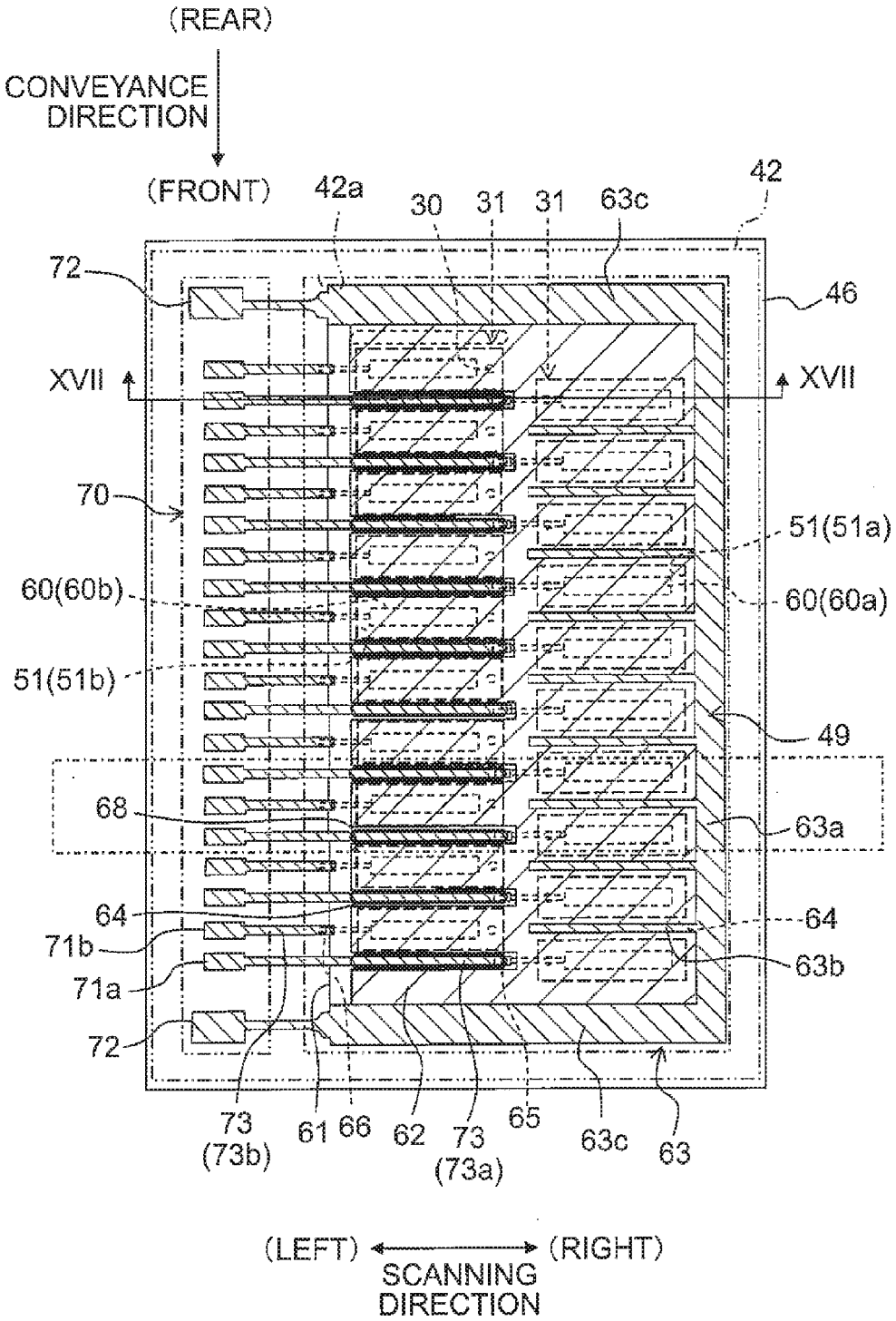
FIG. 16A depicts a top view illustrating a head unit according to still another modified embodiment.
Figure 16B:
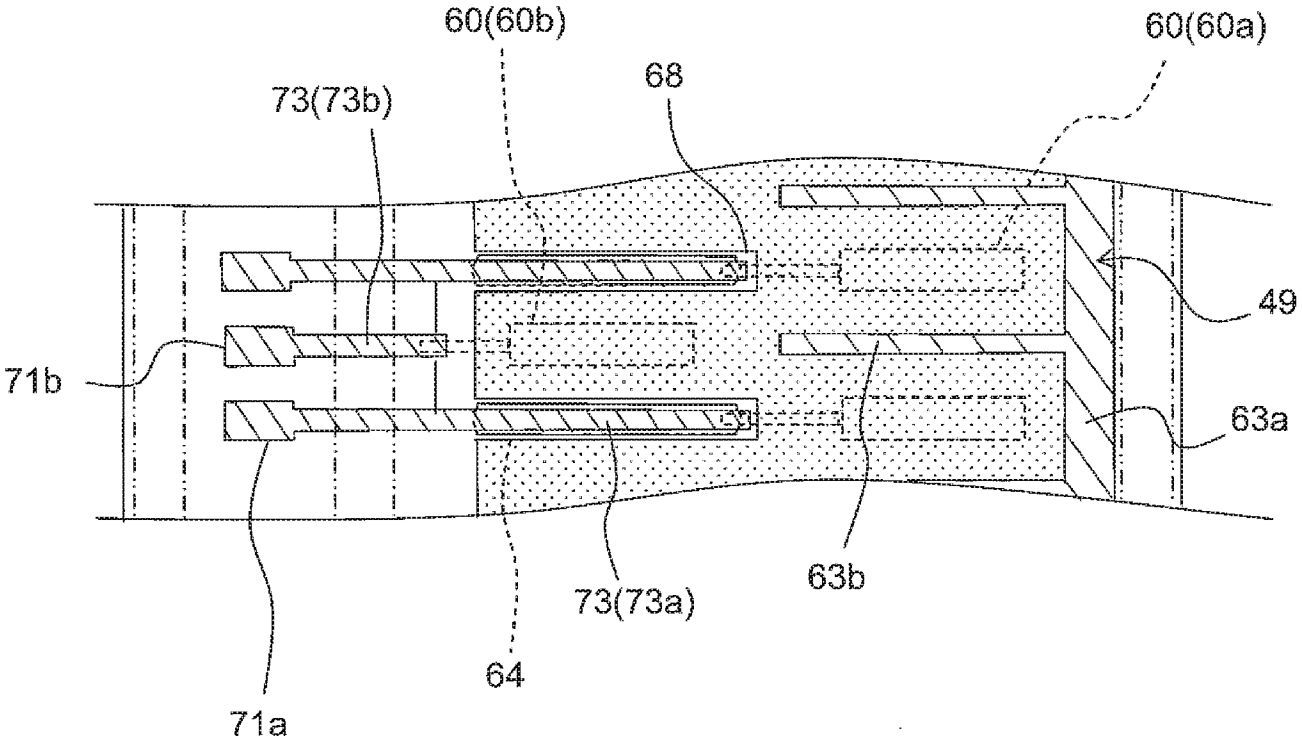
FIG. 16B depicts an enlarged view of a region enclosed by the one-dot chain line depicted in FIG. 16A.
Figure 17:
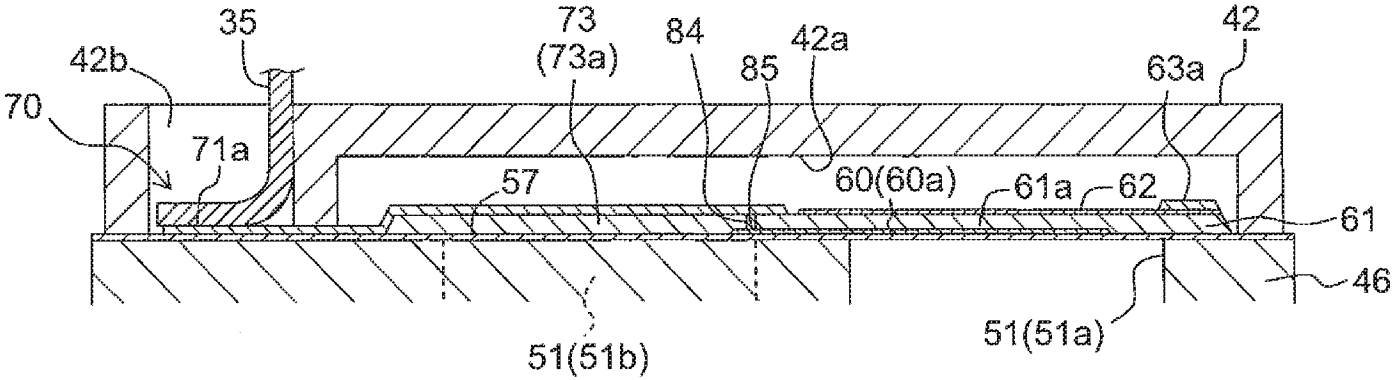
FIG. 17 depicts a sectional view taken along a line XVII-XVII depicted in FIG. 16A.

In the embodiment described above, the slit 64 is formed for the piezoelectric film 61 in the area disposed between the two individual electrodes 60. However, as depicted in FIGS. 16A, 16B and 17, it is also allowable that the slit 64 is not formed for the piezoelectric film 61. In this case, a through-hole 84 is formed through the portion of the piezoelectric film 61 which covers the left end portion of the first individual electrode 60*a*. Owing to the through-hole 84, a part of the left end portion of the first individual electrode 60*a* is exposed to form a first exposed portion 85. Further, the first exposed portion 85 of the first individual electrode 60*a* and the trace 73 formed on the piezoelectric film 61 are connected to one another by means of a conductive material with which the through-hole 84 is filled.

In the embodiment and the modified embodiments thereof explained above, the present teaching is applied to the ink-jet head which discharges the ink onto the recording paper to print an image or the like. However, the present teaching is also applicable to any liquid discharge apparatus which is used in various ways of use other than the printing of the image or the like. The present teaching can be also applied, for example, to a liquid discharge apparatus which discharges a conductive liquid onto a substrate to form a conductive pattern on the surface of the substrate.

What is claimed is:

1. A liquid discharge apparatus configured to discharge liquid, comprising:

a channel substrate including a plurality of first pressure chambers aligned in a first direction, and a plurality of second pressure chambers aligned in the first direction arranged on one side in a second direction orthogonal to the first direction with respect to the plurality of first pressure chambers;

a plurality of first individual electrodes arranged to face the first pressure chambers;

a plurality of second individual electrodes arranged to face the second pressure chambers;

a piezoelectric layer arranged to cover the plurality of first individual electrodes and the plurality of second individual electrodes in a stacking direction;

a common electrode arranged to cover the piezoelectric layer in the stacking direction and face the plurality of first and second individual electrodes; and first traces connected to exposed portions of the first individual electrodes exposed from the piezoelectric layer and each of which passes from a corresponding exposed portion between two of the second individual electrodes adjoining in the first direction to extend to the one side in the second direction, wherein a cutout, which is cut out from the one side in the second direction so that the cutout is not overlapped with the first trace, is formed between portions of the common electrode facing the two second individual electrodes adjoining in the first direction; and the first trace is formed continuously from the corresponding exposed portion to an upper surface of the piezoelectric layer.

2. The liquid discharge apparatus according to claim 1, wherein:

a slit, which extends in the second direction, is formed at a portion of the piezoelectric layer disposed between the two second individual electrodes adjoining in the first direction; and each of the exposed portions is a portion of a corresponding one of the first individual electrodes which extends to the slit and which is exposed from the slit.

3. The liquid discharge apparatus according to claim 1, further comprising an auxiliary conductor which is brought in contact with two different portions of the common electrode.

4. The liquid discharge apparatus according to claim 3, wherein the auxiliary conductor includes a first conductive portion which extends in the first direction on the other side in the second direction as compared with the first individual electrode and which is brought in contact with two portions of the common electrode separated in the first direction.

5. The liquid discharge apparatus according to claim 4, wherein the auxiliary conductor includes a second conductive portion which extends in the second direction from the first conductive portion between two of the first individual electrodes adjoining in the first direction and which is brought in contact with the common electrode.

6. The liquid discharge apparatus according to claim 5, wherein a width in the first direction of the first trace passing between the two second individual electrodes is equal to a width in the first direction of the second conductive portion arranged between the two first individual electrodes.

7. The liquid discharge apparatus according to claim 5, wherein the auxiliary conductor and the first trace are formed of an identical material.

8. The liquid discharge apparatus according to claim 5, wherein a thickness in the stacking direction of the auxiliary conductor is the same as a thickness in the stacking direction of the first trace.

9. The liquid discharge apparatus according to claim 5, wherein the common electrode includes an opening formed in an area in which the second conductive portion is arranged.

10. The liquid discharge apparatus according to claim 9, wherein the common electrode includes the cutout which extends in the second direction and which is formed between the portions opposed to the two second individual electrodes adjoining in the first direction;

the opening, which is formed between portions of the common electrode facing the two first individual electrodes adjoining in the first direction, extends in the second direction; and a length in the second direction of the cutout is the same as a length in the second direction of the opening, and a length in the first direction of the cutout is the same as a length in the first direction of the opening.

11. The liquid discharge apparatus according to claim 4, wherein the auxiliary conductor includes a third conductive portion which extends to the one side in the second direction from the first conductive portion on an outer side in the first direction as compared with the plurality of first individual electrodes and the plurality of second individual electrodes.

12. The liquid discharge apparatus according to claim 11, further comprising second traces which extend to the one side in the second direction from the second individual electrodes.

13. The liquid discharge apparatus according to claim 12, further comprising an electric connecting portion which is provided on the one side of the channel substrate in the second direction as compared with the second pressure chambers and which has first contacts connected to the first traces, second contacts connected to the second traces, and a third contact connected to the third conductive portion of the auxiliary conductor.

14. The liquid discharge apparatus according to claim 3, wherein the auxiliary conductor extends in the second direction between two of the first individual electrodes adjoining in the first direction, and the auxiliary conductor is brought in contact with two portions of the common electrode separated in the second direction.

15. The liquid discharge apparatus according to claim 14, wherein a length in the first direction of the first trace passing between the two second individual electrodes is equal to a length in the first direction of the auxiliary conductor arranged between the two first individual electrodes.

16. The liquid discharge apparatus according to claim 14, wherein the auxiliary conductor and the first trace are formed of an identical material.

17. The liquid discharge apparatus according to claim 14, wherein a length in the stacking direction of the auxiliary conductor is the same as a length in the stacking direction of the first trace.

18. The liquid discharge apparatus according to claim 1, wherein the first trace is formed of one of gold and aluminum.

* * * * *